US010895824B2

(12) United States Patent
Sugiyama et al.

(10) Patent No.: US 10,895,824 B2
(45) Date of Patent: Jan. 19, 2021

(54) DEVELOPING ROLLER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Ryo Sugiyama, Mishima (JP); Yoshinobu Ogawa, Numazu (JP); Masashi Uno, Mishima (JP); Tomoya Uesugi, Susono (JP); Kenta Matsunaga, Susono (JP); Wataru Moriai, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/832,605

(22) Filed: Mar. 27, 2020

(65) Prior Publication Data

US 2020/0310282 A1 Oct. 1, 2020

(30) Foreign Application Priority Data

Apr. 1, 2019 (JP) ..... 2019-070139

(51) Int. Cl.
*G03G 15/08* (2006.01)
*G03G 21/18* (2006.01)

(52) U.S. Cl.
CPC ..... *G03G 15/0818* (2013.01); *G03G 21/1814* (2013.01); *G03G 15/0808* (2013.01)

(58) Field of Classification Search
CPC ..... G03G 15/0808; G03G 15/0818; G03G 2215/0858; G03G 2215/0861
See application file for complete search history.

(56) References Cited

U.S. PATENT DOCUMENTS

2009/0123195 A1* 5/2009 Kusaba ..... G03G 15/0818 399/286
2019/0302642 A1* 10/2019 Sato ..... G03G 15/0818
2019/0324382 A1* 10/2019 Sugiyama ..... G03G 15/0815

FOREIGN PATENT DOCUMENTS

JP 2005258201 A * 9/2005
JP 2005-352017 A 12/2005
JP 2008-112150 A 5/2008
JP 2008-292830 A 12/2008

(Continued)

*Primary Examiner* — Thomas S Giampaolo, II
(74) *Attorney, Agent, or Firm* — Canon U.S.A., Inc. IP Division

(57) ABSTRACT

A developing roller that suppresses contamination of the surface of a photosensitive member and also obtains a high-quality image. The developing roller includes an electro-conductive substrate, an electro-conductive elastic layer and a surface layer which are stacked in this order, wherein the surface layer has resin particles that are dispersed in a polyurethane matrix, an outer surface of the surface layer has a first protrusion originating in first resin particle and a second protrusion originating in second resin particle, wherein the first resin particle contains polyurethane, an elastic modulus $E_1$ of the first resin particle is 100 to 2000 MPa, an elastic modulus $E_2$ of the second resin particle is 2 to 50 MPa, a maximum height roughness Rz of the outer surface is 6 to 18 μm, and a peak vertex density Spd is $5.0\times10^3$ to $5.0\times10^4$(1/mm$^2$).

11 Claims, 4 Drawing Sheets

(56) References Cited

FOREIGN PATENT DOCUMENTS

| | | | |
|---|---|---|---|
| JP | 2009-237042 | A | 10/2009 |
| JP | 2010-008454 | A | 1/2010 |
| JP | 2013-200324 | A | 10/2013 |

* cited by examiner

DEVELOPING ROLLER, PROCESS CARTRIDGE AND ELECTROPHOTOGRAPHIC IMAGE FORMING APPARATUS

BACKGROUND

The present disclosure relates to a developing roller, a process cartridge and an electrophotographic image forming apparatus.

DESCRIPTION OF THE RELATED ART

In recent years, energy saving of an electrophotographic image forming apparatus (hereinafter, also referred to as "image forming apparatus") has advanced, which includes a copying machine, a facsimile, a printer and the like that use an electrophotographic method. One of the methods for saving energy of the image forming apparatus is a method of reducing a torque occurring when members rub against each other (reducing abutting pressure of each member).

As for a process of the image forming apparatus using the above electrophotographic method, firstly, an outer surface of a photosensitive member is charged by a charging unit such as a charging roller. After that, the above outer surface is irradiated with exposure light such as laser light, and has an electrostatic latent image formed thereon. Next, a toner accommodated in a developer container is charged by being rubbed in between the toner regulating member and the developing roller, and at the same time, a developing roller is coated with the resultant toner. The coated toner is conveyed to an abutting portion between the photosensitive member on which the above electrostatic latent image is formed and the developing roller, by a rotation of the developing roller. Then, the toner on the developing roller is rubbed against the photosensitive member by a difference of the number of rotational speed between the developing roller and the photosensitive member, and at the same time, the toner is developed on a photosensitive member by a potential difference between the electrostatic latent image provided on the abutting portion and a voltage applied to the developing roller. After that, the toner which has been developed onto the photosensitive member is transferred to a recording paper directly or via a transfer belt or the like, and is fixed there by heat and pressure. At the time of the transfer, there is a case where a toner which has not been transferred (hereinafter, also referred to as "residual toner") remains on the outer surface of the photosensitive member. Such a residual toner is removed by a cleaning blade which is arranged so as to abut on the photosensitive member. This is a general process of the image forming apparatus.

Here, the cleaning blade is brought in contact with the photosensitive member by a high abutting pressure, and accordingly, a high frictional force is generated by rubbing with the photosensitive member. If the abutting pressure of the cleaning blade on the photosensitive member is reduced, a large effect of saving energy can be expected. However, if the abutting pressure is reduced, the residual toner is not sufficiently removed, and there is a case where the residual toner adheres to the outer surface of the photosensitive member. Such a contamination on the outer surface of the photosensitive member lowers a quality of a subsequently formed electrophotographic image, in some cases.

Japanese Patent Application Laid-Open No. 2008-112150 discloses a developing roller that has urethane particles and urethane particles having an average particle size smaller than that of the previous urethane particles on a surface layer of the developing roller, for the purpose of suppressing fusion bonding of the toners to a toner regulating member, by reducing a stress onto the toners on the developing roller due to the rubbing between the developing roller and the toner regulating member. In addition, Japanese Patent Application Laid-Open No. 2009-237042 discloses a developing roller that has acrylic particles and urethane particles having an average particle size smaller than that of the acrylic particles on a surface layer of the developing roller, for the purpose of suppressing fusion bonding of the toners to the developing roller, by reducing a stress onto the toner on the developing roller due to the rubbing between the developing roller and the toner regulating member.

SUMMARY

The present inventors have investigated using the developing roller described in Japanese Patent Application Laid-Open No. 2008-112150 or Japanese Patent Application Laid-Open No. 2009-237042 as a developing roller, in order to suppress sticking of the residual toner to the outer surface of the photosensitive member. However, even in the cases where these developing rollers were used, such an effect was limited as to prevent the toner component from sticking to the outer surface of the photosensitive member.

One aspect of the present disclosure is directed to providing a developing roller that can more adequately suppress the contamination on the outer surface of the photosensitive member, even when the abutting pressure of the cleaning blade against the photosensitive member has been reduced. Another aspect of the present disclosure is directed to providing a process cartridge that contributes to a stable formation of a high-quality electrophotographic image. Further another aspect of the present disclosure is directed to providing an electrophotographic image forming apparatus that can stably form a high-quality electrophotographic image.

According to one aspect of the present disclosure, there is provided a developing roller comprising:

an electro-conductive substrate;

an electro-conductive elastic layer on the electro-conductive substrate; and a surface layer on the electro-conductive elastic layer, the surface layer comprising a matrix and resin particles dispersed in the matrix, the matrix containing polyurethane as a binder, the resin particles including a first resin particle and a second resin particle, the matrix having an elastic modulus $E_b$ of 10 to 100 MPa when measured at a region in a cross section in a thickness direction of the surface layer, the region being a depth of 1.0 μm or more from an outer surface of the surface layer, the outer surface of the surface layer having a first protrusion and a second protrusion, the second protrusion existing in an area which is free from the first protrusion, the second protrusion having a height lower than a height of the first protrusion by 5.0 μm or more, the first protrusion being formed by the first resin particle, the second protrusion being formed by the second resin particle, the first resin particle comprising polyurethane, and having an elastic modulus $E_1$ of 100 to 2000 MPa when measured in a cross section in a thickness direction of the surface layer, the second resin particle having an elastic modulus $E_2$ of 2 to 50 MPa when measured in a cross section in the thickness direction of the surface layer, the outer surface of the developing roller having a maximum height roughness of 6 to 18 μm, and having a peak vertex density Spd of $5.0\times10^3$ (1/mm$^2$) to $5.0\times10^4$ (1/mm$^2$).

In addition, according to another aspect of the present disclosure, there is provided a process cartridge that is detachably mounted on an image forming apparatus, and has the above developing roller.

Furthermore, according to another aspect of the present disclosure, there is provided an electrophotographic image forming apparatus that has a photosensitive member and a developing roller for supplying a developer to an electrostatic latent image formed on the photosensitive member, wherein the developing roller is the above developing roller.

Further features of the present disclosure will become apparent from the following description of exemplary embodiments with reference to the attached drawings.

BRIEF DESCRIPTION OF THE DRAWINGS

FIG. 1A illustrates a state at the time when a photosensitive member does not abut on the surface layer; and FIG. 1B illustrates a state at the time when the photosensitive member abuts on the surface layer.

DESCRIPTION OF THE EMBODIMENTS

Figure 1A:
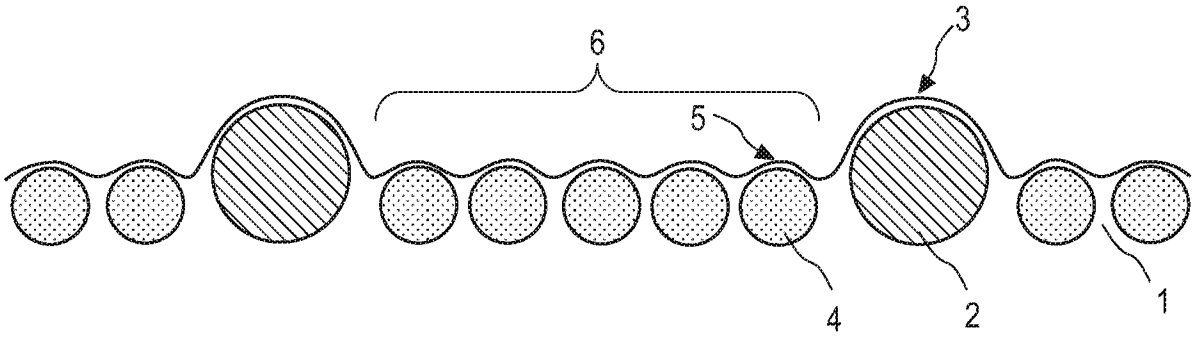
FIGS. 1A and 1B illustrate a cross-sectional view of a part of a surface layer of a developing roller according to one aspect of the present disclosure.

Preferred embodiments of the present disclosure will now be described in detail in accordance with the accompanying drawings.

The present inventors have repeatedly studied the reason why even when the developing roller according to Japanese Patent Application Laid-Open No. 2008-112150 has been used, the effect of suppressing the sticking of the toner component to the outer surface of the photosensitive member is limited, and the degradation of an image quality due to contamination of the outer surface of the photosensitive member cannot be sufficiently suppressed. In the process, the present inventors have recognized that the degradation of the image quality of an electrophotographic image due to the contamination of the outer surface of the photosensitive member involves the degradation of the image quality due to two different reasons.

A first reason is that the density of an image (one-dot image) decreases, which is composed of a collection of minute electrostatic latent images of every one dot, such as a security image (an image in which characters such as "COPY" can appear in sharp relief by copying). This phenomenon is considered to be caused by the deposition of an external additive in the toner, which is represented by silica or the like, onto the outer surface of the photosensitive member. In the case where the abutting pressure of the cleaning blade has been reduced, a toner component remaining on the outer surface of the photosensitive member, particularly an external additive having a small particle size such as silica, cannot be scraped off and is apt to pass through the cleaning blade. In such a case, the toner is compacted when passing through the abutting portion between the cleaning blade and the photosensitive member or the abutting portion between the charging roller or the like and the photosensitive member, and is apt to be deposited on the outer surface of the photosensitive member. It has been found that in this case, the density of the one-dot image decreases. This is assumed to be because a deposition layer of the external additive is formed on the outer surface of the photosensitive member, and thereby it becomes difficult for the exposure light to reach the outer surface of the photosensitive member.

In an ordinary electrophotographic apparatus, an image is formed by a dither method in which a combination of a plurality of (for example, eight) dots is regarded as one large dot. This is because when the dither method is used, an area eight times as large as 1 dot can be irradiated with laser light when an electrostatic latent image is formed, accordingly, a sharp electrostatic latent image is apt to be formed, and as a result, a higher quality image can be obtained. On the other hand, in the case where an image is composed from a collection of minute electrostatic latent images of every one dot (for example, in the case of 600 dpi, 42 μm square) as in the security image, an area which can be irradiated with the laser light is narrow, and it is difficult that a sharp electrostatic latent image is formed. It is assumed that in the case of such a one-dot image, it becomes more difficult that the electrostatic latent image is formed when a deposition layer of the external additive or the like is formed on the outer surface of the photosensitive member, and thereby a decrease in the density becomes apparent. This deposition of the external additive has been remarkable at the time of endurance in a low-temperature and low-humidity environment in which the external additive is strongly charged and is apt to move to each member.

Here, there was a case where when the developing roller described in Japanese Patent Application Laid-Open No. 2008-112150 was used, the developing roller could not suppress the above deposition of the external additive on the outer surface of the photosensitive member, and the density of one-dot image decreased. This is assumed to be because although the developing roller disclosed in Japanese Patent Application Laid-Open No. 2008-112150 had an effect of suppressing a toner stress at the abutting portion on the photosensitive member, the developing roller could not sufficiently remove the external additive compacted on the outer surface of the photosensitive member by another member such as a cleaning blade or a charging roller, and resisted suppressing the deposition. On the other hand, when a developing roller described in Japanese Patent Application Laid-Open No. 2009-237042 has been used, acrylic particles having a high hardness and a large particle diameter can exist on the surface layer of the developing roller. Here, "an outer surface of the surface layer" means a surface of the surface layer opposed to a surface facing the electro-conductive substrate. It has been confirmed that in that case, protrusions on an outer surface of the surface layer, which are formed of the acrylic particles and have high hardness, rub the outer surface of the photosensitive member, and thereby promote the removal of the above compacted external additive. However, it has been found that even in the case where the developing roller described in Japanese Patent Application Laid-Open No. 2009-237042 has been used, another degradation of an image quality occurs, which accompanies the following contamination of the photosensitive member.

A second reason is an occurrence of a white spot which is a white particulate image loss. This phenomenon is considered to be caused by a phenomenon that a resin component in the toner adheres to the outer surface of the photosensitive member as a lump-like fusion bonded material. When the developing roller described in Japanese Patent Application Laid-Open No. 2009-237042 is used, the acrylic particles have the large size as described above and accordingly can rub the outer surface of the photosensitive member, but on the other hand, result in being selectively worn at the abutting portion on a member such as the toner regulating member in addition to the photosensitive member. As a result, the protrusions on the outer circumferential surface of the surface layer, which have a high hardness and are formed of the acrylic particles, are smoothed into a table shape. It has been found that when the endurance progresses in this state, the toner is crushed between the acrylic particle smoothed into a table shape and the photosensitive member, and the toner is apt to be fusion bonded onto the outer surface of the photosensitive member. In addition, when the abutting pressure of the cleaning blade has been reduced, the toner fusion bonded onto the outer surface of the photosensitive member is not scraped off by the cleaning blade, but remains on the outer surface of the photosensitive member. Furthermore, the toner which has been fusion bonded on to the outer surface of the photosensitive member becomes a starting point, and the fusion bonded toner becomes coarse acceleratingly and becomes a lump-like fusion bonded material. When a lump-like fusion bonded material is formed on the outer surface of the photosensitive member in this way, the toner cannot move from the developing roller to the photosensitive member at the portion, in other words, cannot develop the image, and the white spot occurs in the image. This phenomenon has been remarkable in endurance under a high-temperature and high-humidity environment in which the toner has easily collapsed by the influence of heat and humidity.

In addition, it has been found that when the developing roller described in Japanese Patent Application Laid-Open No. 2009-237042 has been used, the developing roller can suppress the decrease of the density of one-dot image as described above, but the granularity in the one-dot image deteriorates. This is assumed to be caused by a phenomenon that when the protrusions of the developing roller, which have high hardness and are formed of the acrylic particles, strongly rub the outer surface of the photosensitive member, the protrusions disarrange a toner group that has developed a fine electrostatic latent image on the outer surface of the photosensitive member, which forms one-dot image.

As described above, there is a trade-off relationship between the suppression of the contamination of the outer surface of the photosensitive member and the suppression of the deterioration of the granularity in the one-dot image, which is a disadvantage for realizing the reduction of the abutting pressure of the cleaning blade.

The present inventors have made an extensive investigation, and as a result, have found that the above disadvantages can be solved by forming the surface layer of the developing roller by combining a matrix containing the following particular resin as a binder with a resin particle, and designing the surface layer so as to have a particular surface profile.

Specifically, the developing roller according to one aspect of the present disclosure includes:

an electro-conductive substrate, an electro-conductive elastic layer on the electro-conductive substrate, and a surface layer on the electro-conductive elastic layer, wherein the surface layer includes a matrix that contains polyurethane as a binder, and resin particles that are dispersed in the matrix, and when an elastic modulus of the matrix is determined to be $E_b$, which is measured in a cross section in the thickness direction of the surface layer, in the region of which the depth from the outer surface of the surface layer is 1.0 μm or larger, the $E_b$ is 10 MPa ($10\times10^6$ Pa) or higher and 100 MPa ($100\times10^6$ Pa) or lower, wherein the outer surface of the surface layer has a first protrusion, and a second protrusion that exists in an area which is free from the first protrusion, and of which the height is lower than the height of the first protrusion by 5.0 μm or larger, wherein the first protrusion originates in a first resin particle, and the second protrusion originates in a second resin particle; and the first resin particle contains polyurethane, and when the elastic modulus of the first resin particle, which is measured in a cross section in the thickness direction of the surface layer, is determined to be $E_1$, the $E_1$ is 100 MPa ($100\times10^6$ Pa) or higher and 2000 MPa ($2000\times10^6$ Pa) or lower, and an elastic modulus of the second resin particle is determined to be $E_2$, which is measured in a cross section in the thickness direction of the surface layer, the $E_2$ is 2 MPa ($2\times10^6$ Pa) or higher and 50 MPa ($50\times10^6$ Pa) or lower, wherein in the outer surface, a maximum height roughness Rz is 6 μm or larger and 18 μm or smaller, and a peak vertex density Spd is $5.0\times10^3$ (1/mm$^2$) or larger and $5.0\times10^4$ (1/mm$^2$) or smaller.

Due to the elastic modulus $E_1$ of the first resin particle being controlled to 100 MPa or higher, which is measured in a cross section in the thickness direction of the surface layer, and by the average value of the maximum heights Rz of the outer surface being controlled to 6 μm or larger, the surface layer can scrape off the deposition of the external additive, which is the first factor of the degradation of the image quality due to the contamination of the outer surface of the photosensitive member, in other words, can suppress the decrease of the density of the one-dot image. Due to the elastic modulus $E_1$ being controlled to 100 MPa or higher, the first resin particle becomes such a hardness as to be capable of scraping off the deposition layer of the external additive. The average value of the maximum heights Rz is a parameter that expresses the height and frequency of higher protrusions among many protrusions which exist on the outer surface. Due to the average value of the Rz being controlled to 6 μm or larger, the first protrusion existing on the outer surface can have a height enough to protrude the head from the toner layer with which the developing roller has been coated, and rub the photosensitive member, and a frequency enough to sufficiently scrape off the deposition layer.

Furthermore, because the first resin particle contains polyurethane, the wear due to rubbing with the photosensitive member or the toner regulating member is suppressed, and the upper surface of the first protrusion originated in the first resin particle is not smoothed into a table shape, but can maintain the spherical surface. In addition to this, it has been found that due to the elastic modulus $E_1$ of the first resin particle being controlled to 2000 MPa or lower, the developing roller can markedly suppress the collapse of the toner at the time when the first protrusion originated in the first resin particle rubs the photosensitive member, and can suppress the occurrence of the white spot.

Furthermore, it has been found that the developing roller can suppress the deterioration of the granularity in the one-dot image even though there are first resin particles having high hardness, by having the average value of the Rz controlled to 18 μm or smaller; also using a polyurethane resin as a binder contained in the matrix; and having the elastic modulus $E_b$ of the matrix (hereinafter, also referred to as the elastic modulus $E_b$ of the matrix of the surface layer) in the region of which the depth is 1.0 μm or larger from the outer surface of the surface layer, which is measured in a cross section in the thickness direction of the surface layer, having the elastic modulus $E_2$ of the second resin particle, which is measured in the cross section in the thickness direction of the surface layer, and having the peak vertex density Spd each controlled to the above ranges.

Here, in FIG. 1A, a cross-sectional view of a surface layer of the developing roller according to the present aspect is illustrated.

The surface layer includes a matrix of a surface layer 1, and first resin particles 2 and second resin particles 4 as resin particles dispersed in the matrix.

In addition, on the outer surface of the surface layer, there are formed a first protrusion 3 formed by the first resin particle 2, and a second protrusion 5 formed by the second resin particle 4. In a region between the first protrusion 3 (region in which the first protrusion does not exist), a region 6 is included in which a second protrusion 5 exists on the outer surface.

Figure 1B:
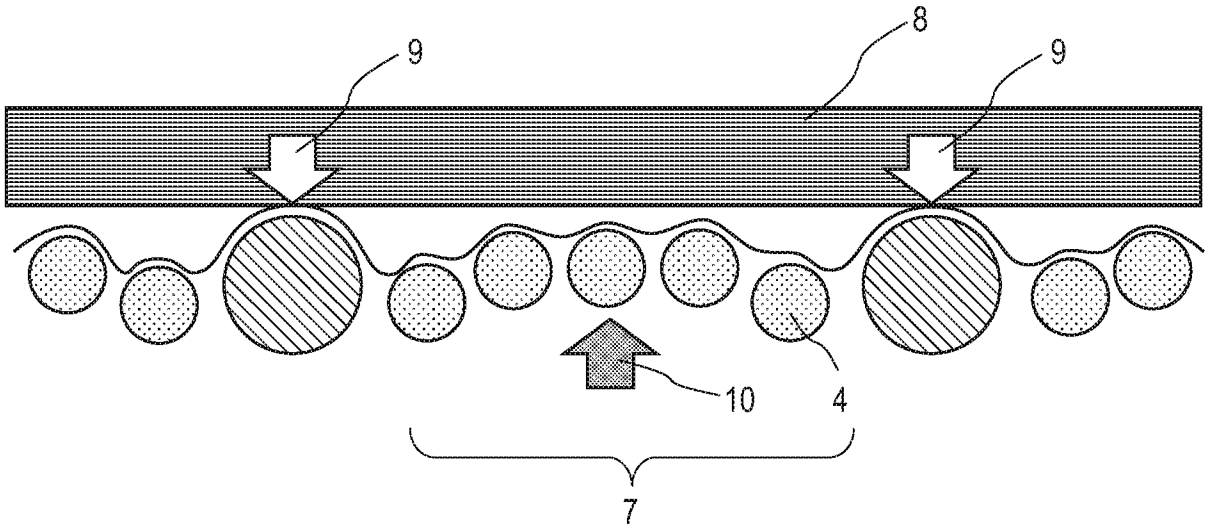

FIG. 1B illustrates a schematic cross-sectional view at the time when the developing roller according to the present aspect and the photosensitive member abut on each other.

As is illustrated in FIG. 1B, due to the configuration of the present disclosure, the first protrusion 3 is pushed in by the photosensitive member 8 with a load 9. At this time, a strong reaction force 10 is generated in the matrix of the surface layer 1, and a region 6 in which the second protrusion exist becomes a region 7 which rises in an arch shape, due to the reaction force 10. This phenomenon is assumed to occur in the following way. The elastic modulus $E_b$ of the matrix of the surface layer is controlled to 100 MPa or lower, the elastic modulus $E_2$ of the second resin particle is controlled to 30 MPa or lower, and thereby the region in which the second protrusions exist becomes flexible. In addition, the first resin particle has high elasticity of 100 MPa or higher, and accordingly the resin particle is pushed in without being deformed when having been pressed by the photosensitive member. Furthermore, both of the first resin particle and the matrix of the surface layer are strongly bonded to each other because both contain polyurethane, and a strong reaction force is generated in the matrix of the surface layer when the first resin particle is pushed in. It is assumed that due to this reaction force, the region which becomes flexible by the existence of the above binder and the second resin particles rises in the arch shape.

Furthermore, in the region 6, a large number of fine protrusions (second protrusions 5) exist due to the second resin particles 4. The toner group which has developed the fine electrostatic latent image on the outer surface of the photosensitive member such as the one-dot image is once disarranged due to rubbing by the first protrusion 3 which is originated in the first resin particle having high hardness.

However, the region in which the second resin particles 4 exist rises in the arch shape and comes close to the photosensitive member 8 as in the above, and thereby the disarranged toner on the photosensitive member is sandwiched between the photosensitive member 8 and the rising region 7 in which the second protrusions 5 exist. At this time, it is presumed that the disarranged toner on the photosensitive member is leveled by a large number of fine second protrusions 5 existing on the outer surface of the developing roller which moves with a speed difference from that of the outer surface of the photosensitive member, and is uniformed again. It is presumed that the deterioration of the granularity in the one-dot image could be suppressed in this way. The average value of Rz which represents the height and frequency of the first protrusion has been controlled to 18 μm or smaller, thereby the region 7 which has risen in the arch shape and in which the second protrusions exist can become sufficiently close to the photosensitive member, and can exhibit the above effect of leveling the toner.

Furthermore, the peak vertex density Spd on the outer surface of the surface layer is a parameter which expresses the number of protrusions (vertexes of peaks) existing per unit area, and when a plurality of types of protrusions exist, strongly depends on a frequency of small protrusions, specifically, of the second protrusions which are originated in the second resin particles in the present disclosure. Due to the Spd being controlled to $5.0\times10^3$ (1/mm$^2$) or larger, in other words, due to the existence of a large number of second protrusions originated in the above second resin particles, the toner which has been disarranged by the above first protrusions can be pushed back by the large number of second protrusions, and can be uniformly leveled. As a result, the deterioration of the granularity in the one-dot image can be suppressed. In addition, due to the Spd being controlled to $5.0\times10^4$ (1/mm$^2$) or smaller, the second protrusions can maintain such a height of the protrusion as to be capable of pushing back and leveling the toner.

A developing roller 20 according to the present aspect will be described in detail below with reference to FIG. 2.

<Developing Roller>

Figure 2:
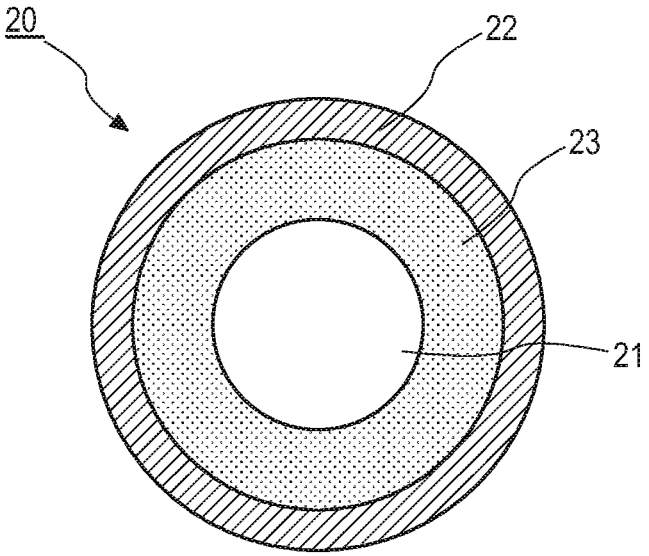
FIG. 2 illustrates a conceptual diagram of a developing roller according to one aspect of the present disclosure.

The developing roller 20 includes an electro-conductive substrate 21, an electro-conductive elastic layer 23 on the electro-conductive substrate, and a surface layer 22 on the electro-conductive elastic layer, as is illustrated in a schematic view of a cross section in a direction vertical to an axial direction in FIG. 2. The electro-conductive elastic layer 23 may have one layer or two or more layers as needed. A surface layer 22 is a single layer.

1. Electro-Conductive Substrate

An electro-conductive substrate has a function of supporting the electro-conductive elastic layer and the surface layer to be provided thereon. Examples of the material of the electro-conductive substrate include metals such as iron, copper, aluminum and nickel; and alloys such as stainless steel, duralumin, brass and bronze, which contain the above metals. These materials may be used alone or in combination with two or more. The surface of the substrate can be plated for the purpose of having scratch resistance imparted thereto, within such a range as not to impair the electro-conductivity. Furthermore, a substrate in which the surface of a substrate made from a resin is coated with a metal and the resultant surface becomes electro-conductive, or a substrate which is produced from an electro-conductive resin composition can be also used.

2. Electro-Conductive Elastic Layer

An electro-conductive elastic layer may be any of a solid body and a foam. In addition, the electro-conductive elastic layer may be formed of a single layer or a plurality of layers. It is preferable that the electro-conductive elastic layer is a solid body, because it becomes easier for the region in which the second resin particles exist to rise in the arch shape due to the reaction force at the time when the first protrusion has been pressed. In addition, it is preferable that the elastic modulus of the electro-conductive elastic layer is 0.5 MPa ($0.5\times10^6$ Pa) or higher and 10 MPa ($10\times10^6$ Pa) or lower. Examples of the material of such an electro-conductive elastic layer include natural rubber, isoprene rubber, styrene rubber, butyl rubber, butadiene rubber, fluorine rubber, urethane rubber and silicone rubber. These materials can be used alone or in combination with one or more other types. Among the materials, silicone rubber is preferable because of having a low elastic modulus.

The electro-conductive elastic layer may contain an electro-conductive agent and a non-electroconductive filler, and various additive components necessary for molding, which include a crosslinking agent, a catalyst and a dispersion accelerator, according to a function required of the developing roller. As the electro-conductive agent, materials can be used which include: various electro-conductive metals or alloys thereof; electro-conductive metal oxides; fine powder of insulative substance coated with the above materials; an electron conductive agent; and an ion conductive agent. These electro-conductive agents can be used alone, or in combination with one or more other types in a form of powder or fiber. Among these materials, carbon black is preferable which is an electron conductive agent, because of easily controlling the electro-conductivity and being economical. Examples of the non-electroconductive filler include the following materials: diatomaceous earth, quartz powder, dry silica, wet silica, titanium oxide, zinc oxide, aluminosilicate, calcium carbonate, zirconium silicate, aluminum silicate, talc, alumina and iron oxide. These materials may be used alone or in combination with two or more.

It is preferable that a volume resistivity of the electro-conductive elastic layer is $1.0\times10^4$ to $1.0\times10^{10}$ Ω·cm. When the volume resistivity of the electro-conductive elastic layer is controlled to this range, the developing roller is apt to suppress a fluctuation of the electric field in the development. It is more preferable that the volume resistivity is $1.0\times10^4$ to $1.0\times10^9$ Ω·cm. Note that the volume resistivity of the electro-conductive elastic layer can be controlled by a content of the above electro-conductive agent in the electro-conductive elastic layer.

It is preferable for the thickness of the electro-conductive elastic layer to be 0.1 mm or larger and 50.0 mm or smaller, and is more preferable to be 0.5 mm or larger and 10.0 mm or smaller.

Examples of a method for forming the electro-conductive elastic layer include a method of molding an electro-conductive elastic layer on a substrate by heating and curing uncured materials for the electro-conductive elastic layer at an appropriate temperature and time period, by various molding methods such as extrusion molding, press molding, injection molding, liquid injection molding and casting molding. For example, the electro-conductive elastic layer can be formed on the outer circumference of the substrate with adequate precision, by a process of injecting the uncured materials for the electro-conductive elastic layer into a cylindrical mold in which the substrate is installed, heating and curing the injected materials.

3. Surface Layer

The surface layer includes a matrix containing polyurethane as a binder, and resin particles that are dispersed in the matrix, and when an elastic modulus of the matrix is determined to be $E_b$, which is measured in a cross section in the thickness direction of the surface layer, in the region of which the depth from the outer surface of the surface layer is 1.0 μm or larger, the $E_b$ is 10 MPa or higher and 100 MPa or lower, wherein the outer surface of the surface layer has a first protrusion, and a second protrusion that exists in the region of the outer surface, in which the first protrusion does not exist, and of which the height is lower than the height of the first protrusion by 5.0 μm or larger, wherein the first protrusion originates in a first resin particle, and the second protrusion originates in a second resin particle; and the first resin particle contains polyurethane, and when the elastic modulus of the first resin particle, which is measured in a cross section in the thickness direction of the surface layer, is determined to be $E_1$, the $E_1$ is 100 MPa or higher and 2000 MPa or lower, and an elastic modulus of the second resin particle is determined to be $E_2$, which is measured in a cross section in the thickness direction of the surface layer, the $E_2$ is 2 MPa or higher and 50 MPa or lower, wherein in the outer surface, a maximum height roughness Rz is 6 μm or larger and 18 μm or smaller, and a peak vertex density Spd is $5.0\times10^3$ (1/mm$^2$) or larger and $5.0\times10^4$ (1/mm$^2$) or smaller.

In addition, an electro-conductive agent can be blended into the surface layer for the purpose of controlling the electro-conductivity of the surface layer. In addition, an additive such as a surface-active agent may be blended for the purpose of controlling releasability of the toner, and the like.

Furthermore, it is more preferable that the vicinity of the outer surface of the surface layer has high hardness, because then the effect of scraping the outer surface of the photosensitive member by the first protrusion increases, and the effect of leveling the toner by the second protrusion increases.

It is preferable that the layer thickness of the surface layer is 4 μm or larger and 100 μm or smaller. The layer thickness is defined as a thickness of a portion in which the first and second protrusions are not formed. The thickness may include the first resin particle which does not form the first protrusion, or the second resin particle which does not form the second protrusion. Due to the layer thickness being controlled to 4 μm or larger, the first protrusion and the second protrusion are apt to be formed which originate in the first resin particle and the second resin particle, respectively, and the average value of Rz and Spd are apt to be set to the above range. In addition, due to the layer thickness being controlled to 4 μm or larger, even when the vicinity of the outer surface of the surface layer is highly hardened, the influence of the elastic modulus $E_b$ of the matrix of the surface layer becomes dominant, and flexible deformation of the surface layer is apt to occur, which is preferable. It is preferable that the layer thickness is controlled to 100 or smaller, because the flexible deformation of the surface layer is apt to occur. The layer thickness is more preferably 6 μm or larger and 30 μm or smaller.

3-1. Matrix

The matrix contains polyurethane as a binder. Because the matrix contains the polyurethane, the adhesiveness of the matrix to the first resin particle containing the polyurethane improves. It is assumed that a strong reaction force is thereby generated in the matrix of the surface layer when the first resin particle is pushed in, and a region which becomes flexible due to the existence of the matrix of the surface layer and the second particle can rise in an arch shape. In addition, the polyurethane contained in the matrix of the surface layer is not limited in particular, as long as the polyurethane can exhibit the above elastic modulus $E_b$. The polyurethane can be obtained from a polyol, an isocyanate, and a chain extender as needed. Examples of the polyol which becomes a raw material of the polyurethane include polyether polyol, polyester polyol, polycarbonate polyol, polyolefin polyol, acrylic polyol, and mixtures thereof. Examples of the isocyanate which becomes the raw material of the polyurethane include the following: tolylene diisocyanate (TDI), diphenylmethane diisocyanate (MDI), naphthalene diisocyanate (NDI), tolidine diisocyanate (TODD, hexamethylene diisocyanate (HDI), isophorone diisocyanate (IPDI), phenylene diisocyanate (PPDI), xylylene diisocyanate (XDI), tetramethyl xylylene diisocyanate (TMXDI), cyclohexane diisocyanate, and mixtures thereof. Examples of the chain extender which becomes the raw material of the polyurethane include: bifunctional low molecular weight diols such as ethylene glycol, 1,4-butanediol and 3-methylpentanediol; trifunctional low molecular weight triols such as trimethylolpropane; and mixtures thereof. In addition, a prepolymer-type isocyanate compound may be used which is obtained by previously reacting the above various isocyanate compounds with various polyols in such a state that isocyanate groups are excess, and which has an isocyanate group at a terminal. In addition, as these isocyanate compounds, materials may be used in which isocyanate groups are blocked by various blocking agents such as MEK oxime.

Whatever material has been used, the polyurethane can be obtained by a reaction between the polyol and the isocyanate, which is caused by heating. Furthermore, when one or both of the polyol and the isocyanate have a branched structure and the number of functional groups is 3 or more, the obtained polyurethane becomes cross-linked polyurethane.

In addition, an elastic modulus $E_b$ of the matrix at a depth of 1 μm or larger from the outer surface of the matrix, which can be measured by a method that will be described later, is 10 MPa or higher and 100 MPa or lower. Due to the elastic modulus $E_b$ being controlled to 10 MPa or higher, the surface layer can acquire an effect of scraping off the deposition layer of the external additive, when the first resin particles are coated to form the first protrusions. In addition, due to the elastic modulus $E_b$ being controlled to 100 MPa or lower, in the region in which the second protrusions exist, the matrix can flexibly deform together with the second resin particles. It is presumed that the region in which the second protrusions exist can rise in the arch shape, when the first protrusion has been pushed in by the photosensitive member, and can come close to the photosensitive member up to a distance of being capable of leveling the toner. It is more preferable that the elastic modulus $E_b$ is 50M or lower, because then it becomes easy for the region in which the second protrusion exists to come close to the photosensitive member, even in the case where the height of the first protrusion is high and the frequency is high.

The elastic modulus $E_b$ of the matrix can be adjusted to the above range by a molecular structure of the resin and/or an interaction due to the addition of a fine particle such as silica and carbon black.

3-2. First Protrusion and Second Protrusion

In the outer surface of the surface layer, there exist a first protrusion, and a second protrusion that exists in a region of the outer surface, in which the first protrusion does not exist, and that has a height lower than the height of the first protrusion by 5.0 μm or larger. The first protrusion originates in the following first resin particle, and the second protrusion originates in the following second resin particle. It can be confirmed that the first protrusion and the second protrusion exist in the outer surface of the surface layer, by confirming two protrusions which exist in the outer surface of the surface layer and have a height difference of 5.0 μm or larger, by a method that will be described later, and measuring the elastic moduli of particles which form the two protrusions, by a method that will be described later.

3-3. Average Value of Maximum Height Rz

A maximum height roughness Rz of the outer surface of the surface layer is 6 μm or larger and 18 μm or smaller. The average value of the maximum heights Rz is a numerical value which is obtained by a measurement method that will be described later, and is an average value of a large number of maximum heights Rz; and accordingly is a parameter which can express the height and frequency of higher protrusions in a large number of protrusions existing on the outer surface. In the present disclosure, the first protrusion is higher than the second protrusion, and accordingly the average value of Rz has a strong correlation with the height and the frequency of the first protrusions. Due to the average value of Rz being controlled to 6 μm or larger, the first protrusions acquire the height and frequency enough to protrude from the toner layer with which the developing roller is coated, rub the photosensitive member, and scrape off the above deposition layer of the above external additive. In addition, due to the average value of Rz being controlled to 18 μm or smaller, when the region in which the second protrusions exist has risen in the arch shape, the region can sufficiently come close to the photosensitive member, and can exhibit an effect of leveling the above toner.

In addition, it is more preferable that the average value of Rz is controlled to 8 μm or larger and 16 μm or smaller. Due to the average value of Rz being controlled to the above range, it becomes easy for the protrusions originating in the following first resin particles to scrape off even the toner crushed on the outer surface of the photosensitive member by a cleaning blade or a charging roller, in addition to the deposition layer of the external additive. Thereby, the protrusions can further prevent a growth of the lump-like fusion bonded toner, and suppress the occurrence of the white spot, which are preferable.

The average value of Rz has a strong correlation with the height and frequency of the first protrusions as described above, and accordingly can be adjusted mainly by a volume average particle diameter of and an amount of the raw material of the first resin particles to be blended. In addition, a degree of protrusion of the first protrusion can be changed and the average value of Rz can be adjusted also by the volume average particle diameter of and an amount of the raw material of the following second resin particles to be blended, and the layer thickness of the surface layer. Here, the volume average particle diameter of the resin particles of the raw material is a median diameter by a "laser diffraction/scattering method" with the use of a particle size distribution measurement device as will be described in Examples which will be described later.

3-4. Peak Vertex Density Spd

The peak vertex density Spd of the outer surface of the surface layer, which can be measured by a method that will be described later, is $5.0\times10^3$ (1/mm$^2$) or higher and $5.0\times10^4$ (1/mm$^2$) or lower. The peak vertex density Spd is a parameter which expresses the number of protrusions existing per unit area, and shows a strong correlation with the frequency of small protrusions, when there are a large number of protrusions. Accordingly, the Spd has a strong correlation with the frequency of the second protrusions. Due to the Spd being controlled to $5.0\times10^3$ (1/mm$^2$) or higher, in other words, due to a large number of second protrusions existing, the large number of second protrusions can push and can uniformly level the toners which have been disarranged by the above first protrusion. Thereby, the second protrusions can suppress the deterioration of granularity in the one-dot image. In addition, due to the Spd being controlled to $5.0\times10^4$ (1/mm$^2$) or lower, the second protrusion can maintain such a height of protrusion as to be capable of pushing and leveling the toners. In addition, it is more preferable to control the Spd to $1.0\times10^4$ (1/mm$^2$) or higher and $3.5\times10^4$ (1/mm$^2$) or lower. The Spd controlled to the above range is preferable, because the second protrusions can have such a density and heights as to be capable of exhibiting an effect of more sufficiently leveling the toners, even in the case where the above average value of Rz has been controlled to 8 μm or larger, and can suppress the deterioration of the granularity in the one-dot image.

The Spd in the present disclosure can be adjusted by the volume average particle diameters of and the amounts of the following first resin particles and the following second resin particles to be blended. The Spd has a strong correlation with the frequency of the relatively small second protrusions among the factors, as described above, and can be adjusted mainly by the volume average particle diameter of and the amount of the second resin particles to be blended.

3-5. First Resin Particle

The first resin particle exists inside the above first protrusion, and the first resin particle contains polyurethane. Due to the first resin particle containing polyurethane, the wear due to rubbing with the photosensitive member or the toner regulating member is greatly suppressed, and the upper surface of the first protrusion originating in the first resin particle is not smoothed into a table shape, but can maintain the spherical surface. Thereby, the collapse of the toner is suppressed, and the occurrence of the white spot can be suppressed. In addition, because of containing polyurethane, the first resin particle can improve the adhesiveness to the above matrix which contains polyurethane. Thereby, the first resin particle can generate a strong reaction force in the matrix of the surface layer when having been pushed in, and can raise a region which has become flexible by the matrix and the existence of the second particle, into an arch shape.

The polyurethane contained in the first resin particles is not limited in particular, as long as the elastic modulus $E_1$ of the first resin particle can be controlled to 100 MPa or higher and 2000 MPa or lower. Examples of the polyurethane include ether-based polyurethane, ester-based polyurethane, acrylic-based polyurethane, polycarbonate-based polyurethane and polyolefin-based polyurethane.

Due to the first resin particle of which the elastic modulus $E_1$ is controlled to 100 MPa or higher, the first protrusion acquires such a hardness as to be capable of scraping off the deposition layer of the external additive.

Furthermore, due to the elastic modulus $E_1$ being controlled to 100 MPa or higher, the first resin particle is not deformed but is pushed into the inner part of the surface layer, when having been pressed by abutment on the photosensitive member. Thereby, a strong reaction force is generated in the matrix, and the reaction force can raise the region in which the second resin particle exists, into the arch shape. In addition, due to the elastic modulus $E_1$ being controlled to 2000 MPa or lower, the first protrusion originating in the first resin particle remarkably suppresses the collapse of the toner when having rubbed the photosensitive member, and can suppress the occurrence of the white spot. A more preferable range of the elastic modulus $E_1$ is 1000 MPa or higher and 2000 MPa or lower. Due to the elastic modulus $E_1$ being controlled to 1000 MPa or higher, it becomes easy for the first protrusion to scrape off even the toner which is crushed onto the outer surface of the photosensitive member by a cleaning blade, a charging roller or the like, and more resists being scraped off than the deposition layer of the external additive. This high elastic modulus is preferable because the first protrusion can thereby further prevent the growth of a lump-like fusion bonded toner, and suppress the occurrence of the white spot. The elastic modulus $E_1$ of the first resin particle can be adjusted to the above range by the molecular structure and the degree of cross-linking of the resin.

It is preferable that the volume average particle diameter of the first resin particles in the surface layer is 10 μm or larger and 20 μm or smaller. Due to the volume average particle diameter being controlled to 10 μm or larger, it becomes easy for the first protrusion originating in the first resin particle to protrude from the toner coating layer on the outer surface of the developing roller, and to scrape the photosensitive member. In addition, due to the volume average particle diameter being controlled to 20 μm or smaller, it is easy for the first protrusion to suppress the deterioration of the granularity in the one-dot image, without excessively disarranging the toner which has been developed on the photosensitive member by a coarse particle, which is preferable. A more preferable range is 13 μm or larger and 18 μm or smaller. The volume average particle diameter is a volume average particle diameter of the first resin particles in a state of being contained in the surface layer that has been formed by a method which will be described later, and a measurement method thereof will be also described later.

In addition, it is preferable that the first resin particles are contained in the surface layer in an amount of 3% by volume or more and 25% by volume or less. Due to the content being controlled to 3% by volume or more, it is easy for the first protrusion to exist with such a frequency as to be capable of scraping off the deposition layer of the external additive. In addition, due to the content being controlled to 25% by volume or less, it becomes difficult for the first protrusion to disarrange the toner developed onto the photosensitive member with excessive frequency, and it is easy to suppress the deterioration of the granularity in the one-dot image. More preferably, the content is 8% by volume or more and 20% by volume or less. Due to the content being controlled to 8% by volume or more and 20% by volume or less, it becomes easy for the first protrusion to scrape off even the toner crushed onto the outer surface of the photosensitive member by a cleaning blade, a charging roller or the like, which more resists being scraped off than the deposition layer of the external additive. Thereby, the protrusions can further prevent a growth of the lump-like fusion bonded toner, and suppress the occurrence of the white spot, which are preferable.

3-6. Second Resin Particle

The elastic modulus $E_2$ of the second resin particles is 2 MPa or higher and 50 MPa or lower. Due to the elastic modulus $E_2$ being controlled to 2 MPa or higher, the second resin particles can suppress the deformation due to the pressure from the toners which are sandwiched between the second protrusions and the photosensitive member, when the region in which the second resin particles exist comes close to the photosensitive member, and pushes and levels the toners. Thereby, the second resin particles can maintain such a height of protrusion as to be capable of pushing and leveling the toners, exhibit the effect of leveling the toners, and can suppress the deterioration of the granularity in the one-dot image. In addition, due to the elastic modulus being controlled to 50 MPa or lower, the region 6 in which the second protrusions exist becomes flexible. It is assumed that the region 6 thereby rises in the arch shape by the reaction force at the time when the first protrusion is pressed by the photosensitive member, accordingly comes close to the photosensitive member, and exhibits the effect of leveling the toners, which has been capable of suppressing the deterioration of the granularity in the one-dot image. The elastic modulus $E_2$ of the second resin particle can be adjusted to the above range, by a molecular structure and a degree of cross-linking of the resin.

Examples of the material of the second resin particle include polyurethane and silicone. Among the materials, a resin particle containing the polyurethane is preferable, because of being apt to adhere to the matrix containing the polyurethane, being apt to receive the reaction force at the time when the first protrusion is pressed, and being apt to rise in the arch shape.

In addition, the volume average particle diameter of the second resin particles in the surface layer is smaller than the volume average particle diameter of the first resin particles in the surface layer. Thereby, the first protrusions originating in the first resin particles can become higher than the second protrusions originating in the second resin particles. The difference between the volume average particle diameter of the first resin particles and the volume average particle diameter of the second resin particles is preferably 5 μm or larger and 15 μm or smaller. The difference controlled to 5 μm or larger is preferable, because the first protrusion protrudes from the toner coating layer at the time when the outer surface of the developing roller is coated with the toner, and is apt to scrape the outer surface of the photosensitive member. In addition, the difference controlled to 15 μm or smaller is preferable, because when the region in which the second resin particles exist has risen in the arch shape, the region is apt to come close to the photosensitive member and level the toners on the photosensitive member. It is preferable that the volume average particle diameter of the second resin particles is 3 μm or larger and 10 μm or smaller. The volume average particle diameter controlled to 3 μm or larger is preferable, because when the second protrusions come close to the photosensitive member and level the toners, the second protrusions are apt to form such a height of protrusion as to be capable of pushing the toners. In addition, the volume average particle diameter controlled to 10 μm or smaller is preferable, because the second protrusions originating in the second resin particles are apt to become highly dense and fine, and to exhibit the effect of leveling the above toners. The volume average particle diameter is more preferably 4 μm or larger and 8 μm or smaller. The volume average particle diameter is a volume average particle diameter of the second resin particles in a state of being contained in the surface layer that has been formed by a method which will be described later, and a measurement method thereof will be also described later.

In addition, it is preferable that the second resin particles are contained in the surface layer in an amount of 15% by volume or more and 50% by volume or less. The content controlled to 15% by volume or more is preferable, because the second protrusions originating in the second resin particles are apt to become highly dense and fine, and to exhibit the effect of leveling the above toners. In addition, the content controlled to 50% by volume or less is preferable, because the second protrusion is apt to become appropriately high, and when the second protrusions come close to the photosensitive member and level the toners, is apt to form such a height of protrusion as to be capable of pushing the toners. The content is more preferably 25% by volume or more and 40% by volume or less. The content controlled to the above range is preferable, because the second protrusions can have such a density and heights as to be capable of exhibiting an effect of more sufficiently leveling the toners, even in the case where the above average value of Rz has been controlled to 8 μm or larger, and can suppress the deterioration of the granularity in the one-dot image.

Due to the first resin particles and the second resin particles being controlled as above, the average value of Rz and Spd of the outer surface of the surface layer can be adjusted to the range of the present disclosure.

3-7. Electro-Conductive Agent

An electro-conductive agent can be blended into the surface layer for the purpose of controlling the electro-conductivity of the surface layer. Examples of the electro-conductive agent to be blended in the surface layer include an ion conductive agent and an electron conductive agent such as carbon black. Among the agents, carbon black is preferable because of being capable of controlling the electro-conductivity of the electro-conductive elastic layer, and a charging property of the electro-conductive elastic layer for the toner. It is preferable that the volume resistivity of the electro-conductive elastic layer is in a range of $1\times10^3$ Ω·cm or more and $1\times10^{11}$ Ω·cm or less.

3-8. Additive

The surface layer can contain various additives in such a range as not to impair the features of the present disclosure. For example, a fine particle of an inorganic compound such as silica which has been blended into the surface layer can impart a reinforcing property to the surface layer, and adjust the elastic modulus $E_b$ of the binder resin. In addition, it is acceptable to blend an organic compound-based additive such as silicone oil into the surface layer, for the purpose of improving the performance which is required for the developing roller, such as the improvement of the toner releasability and the reduction of the coefficient of kinetic friction.

3-9. Method for Forming Surface Layer

A method for forming the surface layer is not limited in particular, but the surface layer can be formed, for example, by the following method. A coating liquid for forming the surface layer is prepared, which contains: the above binder resin, and the first and second resin particles; and if necessary, the above electro-conductive agent and the above additive. The surface layer is formed on a substrate by a process of dipping a substrate or a substrate on which an electro-conductive elastic layer or the like has been formed, in the coating liquid, and drying the resultant substrate.

4. Imparting High Hardness to Vicinity of Outer Surface of Surface Layer

As for the surface layer, when an elastic modulus of the matrix in a region in the vicinity of the outer surface, specifically, in a first region in a cross section in a thickness direction of the surface layer from an outer surface of the surface layer to a depth of 0.1 μm from the outer surface, is defined as $E_b0$ (hereinafter, also referred to as elastic modulus $E_b0$ in vicinity of outer surface), the $E_b0$ is preferably 200 MPa ($200\times10^6$ Pa) or higher and 30,000 MPa (30 GPa=$30{,}000\times10^6$ Pa) or lower. Due to the elastic modulus $E_b0$ in the vicinity of the outer surface being controlled to be 200 MPa or higher, the matrix which covers the first resin particles and forms the first protrusions becomes highly hard, and can increase such an effect of the first protrusion as to scrape the photosensitive member.

In addition, a matrix also becomes highly hard which covers the second resin particles and forms the second protrusions, and the adhesive force to the toner decreases. Thereby, the toners are apt to flow and are more apt to be leveled, when the second protrusions level the toners which have developed the latent image on the photosensitive member. In addition, it is preferable to control the elastic modulus $E_b0$ in the vicinity of the outer surface of the matrix to 30 GPa or lower, because thereby the surface layer is apt to keep the inherent flexibility. Due to the elastic modulus $E_b0$ being controlled to 30 GPa or lower only in the vicinity of the outer surface, the surface layer is apt to maintain such flexibility that a region in which the second resin particles exist can rise in the arch shape due to a reaction force at the time when the first protrusion is pressed, while exhibiting the effect caused by that the above vicinity of the outer surface becomes highly hard.

It is preferable that the region in which the surface layer in the vicinity of the outer surface is highly hardened exists at a depth shallower than 1 μm from the outer surface, because then the surface layer is apt to maintain the flexibility.

Such a highly hardened region in the vicinity of the outer surface can be realized by the impregnation of the resin with an acrylic monomer and the cross-linking of the impregnated acrylic monomer. In particular, in the case where the matrix contains polyurethane as a binder, even when the impregnated and cross-linked acrylic monomer (cross-linked acrylic resin) has an extremely high elastic modulus, the polyurethane can suppress the embrittlement of a portion in which the cross-linked acrylic monomer exists due to an effect of its toughness. Furthermore, the above matrix of the surface layer can further contain a surface-active agent such as a silicone-based surface-active agent and a fluorine-based surface-active agent. The surface-active agent may have both of a low polar group such as a silicone-containing group and a fluorine-containing group, and a highly polar group at a modified site. Due to the large difference in polarity between the urethane group or another highly polar group of the polyurethane, and the silicon-containing group or the low polar group such as the fluorine-containing group in a molecule of the surface-active agent, the surface-active agent migrates to the vicinity of the outer surface of the surface layer and stays there, i.e. the matrix in a region ranging from the outer surface of the surface layer to a predetermined depth such as 1.0 μm from the outer surface of the surface layer comprises the surface active agent. Furthermore, when the matrix containing the surface-active agent is impregnated with the acrylic monomer, the acrylic monomer is apt to stay in the vicinity of the surface-active agent. In particular, it is preferable to impregnate an acrylic monomer having a polarity difference close to the highly polar group of the surface-active agent, because then the acrylic monomer is apt to stay in the vicinity of the outer surface. After that, the impregnated acrylic monomer is cross-linked, and thereby the matrix can be locally highly hardened which exists in the vicinity of the outer surface of the surface layer, for example, in a region at a depth shallower than 1.0 μm in depth from the outer surface of the developing roller. In addition, when the polyurethane is cross-linked polyurethane, the polyurethane can form an interpenetrating polymer network structure together with the cross-linked acrylic resin.

The interpenetrating polymer network structure (hereinafter referred to as an IPN structure) is a structure in which two or more polymer network structures are not connected by a covalent bond, but interlace with each other and are intertangled. In addition, this structure does not come loose as long as the molecular chain forming the network is not cut.

There are several methods as the method for forming the IPN structure. The methods include, for example: a sequential network forming method of firstly forming a network of a polymer of a first component, secondly swelling the formed network by a monomer of a second component and the polymerization initiator, and then forming a network of the polymer of the second component; or a simultaneous network forming method of mixing a monomer of the first component and a monomer of the second component which have different reaction mechanisms from each other, and further the respective polymerization initiators; and at the same time, forming the network.

It is preferable that the type of acrylic monomer to be used here is a polyfunctional monomer which has a plurality of acryloyl groups or methacryloyl groups as functional groups, so as to form a cross-linked structure. Here, it is preferable that the number of functional groups is six or less, because then the increase in viscosity of the acrylic monomer is suppressed, and the acrylic monomer does not remain on the outer surface of the surface layer, but is apt to penetrate into the inside. Furthermore, it is more preferable to use an acrylic monomer having 4 or less functional groups, because then the acrylic monomer does not remain on the outer surface of the surface layer but is apt to penetrate into the interior when having been used in combination with the surface-active agent, and is apt to remain in the vicinity of the outer surface of the surface layer, for example, in the region at the depth shallower than 1 μm.

It is preferable that the molecular weight of the above acrylic monomer is in a range of 200 or more and 750 or less. Due to the molecular weight in this range being used, the binder resin contained in the surface layer can be efficiently impregnated, and the vicinity of the outer surface thereof can be highly hardened.

Specifically, the vicinity of the outer surface of the surface layer can be highly hardened by a process of selecting one or two or more acrylic monomers which satisfy the above range of the molecular weight and range of the viscosity, impregnating the surface layer with the acrylic monomer, and cross-linking the impregnated acrylic monomer.

The method of impregnating the surface layer with such an acrylic monomer or the following polymerization initiator is not limited in particular, but the surface layer can be impregnated, for example, by the following method.

A coating liquid is adjusted which contains the above acrylic monomer and, if necessary, a polymerization initiator, a sensitizer, a solvent and the like. Next, the coating liquid is applied to a roller on which the above surface layer has been formed, by a heretofore known coating method such as dipping, roll coating and spray coating. Thereby, the surface layer is impregnated with the acrylic monomer and the like. Next, the solvent is dried as needed, then the acrylic monomer is cross-linked by the following cross-linking method, and thereby the vicinity of the outer surface of the surface layer can be highly hardened.

The method for cross-linking the acrylic monomer is not limited in particular, and a heretofore known method can be used. Specific methods include a method such as heating or irradiation with ultraviolet light.

For each of the polymerization methods, a heretofore known radical polymerization initiator or ionic polymerization initiator can be used.

Examples of the polymerization initiator in the case of polymerization by heating include: peroxides such as 3-hydroxy-1,1-dimethylbutyl peroxyneodecanoate, α-cumyl peroxyneodecanoate, t-butyl peroxyneoheptanoate, t-butyl peroxybivalate, t-amyl peroxy normal octoate, t-butyl peroxy 2-ethylhexyl carbonate, dicumyl peroxide, di-t-butyl peroxide, di-t-amyl peroxide, 1,1-di(t-butylperoxy)cyclohexane, and n-butyl-4,4-di(t-butylperoxy) valerate; and azo compounds such as 2,2-azobisbutyronitrile, 2,2-azobis(4-methoxy-2,4-dimethylvaleronitrile), 2,2-azobis(2,4-dimethylvaleronitrile), 2,2-azobis(2-methylbutyronitrile), 1,1-azobis(cyclohexane-1-carbonitrile), 2,2-azobis[2-(2-imidazolin-2-yl)propane], 2,2-azobis[2-methyl-N-(2-hydroxyethyl)propionamide], 2,2-azobis[N-(2-propenyl)-2-methylpropionamide], 2,2-azobis(N-butyl-2-methoxypropionamide), and dimethyl-2,2-azobis (isobutyrate).

Examples of the polymerization initiator in the case where the acrylic monomer is polymerized by irradiation with ultraviolet rays include: 2,2-dimethoxy-1,2-diphenylethan-1-one, 1-hydroxycyclohexylphenyl ketone, 2-hydroxy-2-methyl-1-phenylpropan-1-one, 1-[4-(2-hydroxyethoxy)-phenyl]-2-hydroxy-2-methyl-1-propan-1-one, 2-hydroxy-1-{4-[4-(2-hydroxy-2-methyl-propionyl)-benzyl]-phenyl}-2-methylpropan-1-one, 2-methyl-1-[4-(methylthio)phenyl]-2-morpholinopropan-1-one, 2-benzyl-2-dimethylamino-1-(4-morpholinophenyl)-butan-1-one, 2-dimethylamino-2-(4-methylbenzyl)-1-(4-morpholin-4-yl-phenyl)-butan-1-one, bis(2,4,6-trimethylbenzoyl)-phenylphosphine oxide, and 2,4,6-trimethylbenzoyl-diphenylphosphine oxide.

In addition, these polymerization initiators may be used alone, or two or more of the polymerization initiators may be concomitantly used.

In addition, it is preferable to use the polymerization initiator which is blended in an amount of 0.5 parts by mass or more and 10 parts by mass or less, when the total amount of the compound for forming the specific resin (for example, compound having (meth)acryloyl group) is 100 parts by mass, from the viewpoint of efficiently proceeding the reaction.

In addition, as for a heating apparatus and an ultraviolet irradiation apparatus, heretofore known apparatuses can be appropriately used. As a light source for emitting ultraviolet rays, lamps can be used such as, for example, an LED lamp, a high-pressure mercury lamp, a metal halide lamp, a xenon lamp, and a low-pressure mercury lamp. An integrated amount of light required for the polymerization can be appropriately adjusted according to the type and amount of a compound and polymerization initiator to be added and used.

Examples of a method for confirming that the cross-linked acrylic resin exists in a state in which the matrix containing the polyurethane is impregnated with the cross-linked acrylic resin include the following methods: (1) a method of confirming the existence by solvent extraction, (2) a method of confirming a change in glass transition points before and after impregnation treatment, (3) a method of confirming a change of peak top temperatures in thermal chromatograms before and after the impregnation treatment, and (4) a method of confirming the existence by μMS.

<Process Cartridge and Image Forming Apparatus>

A process cartridge according to one aspect of the present disclosure is a process cartridge which is detachably mounted on an image forming apparatus, and includes a developing roller according to the present aspect. In addition, the image forming apparatus according to the present aspect includes a photosensitive member, and a developing roller according to the present aspect, which is arranged so as to abut on the photosensitive member. According to the present disclosure, there can be provided a process cartridge and the image forming apparatus which can stably provide a high-quality image under various environments.

Figure 3:
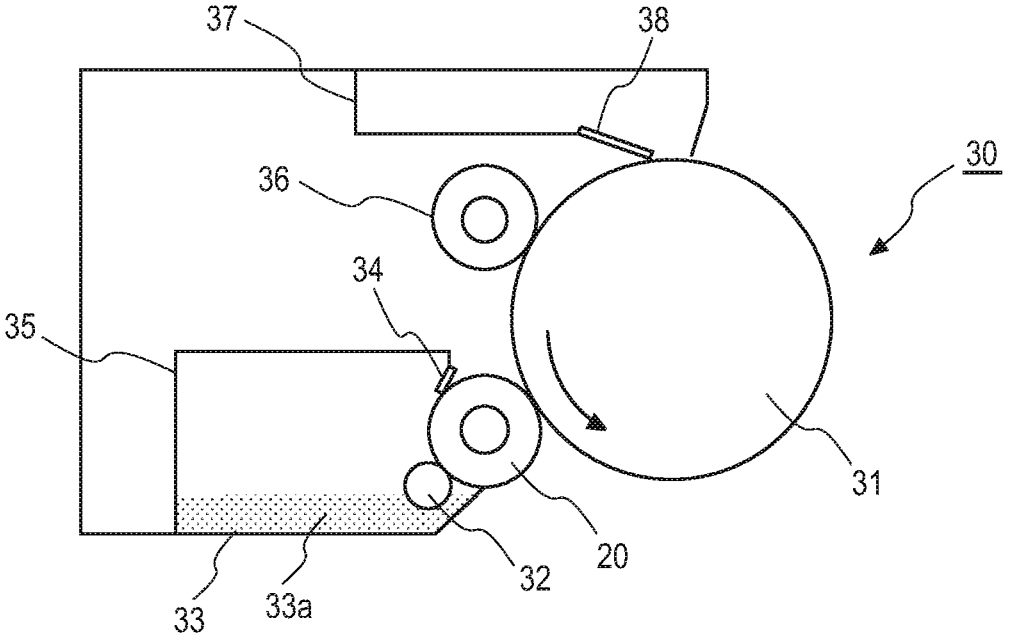
FIG. 3 illustrates a configuration diagram of a process cartridge according to one aspect of the present disclosure.

The process cartridge is illustrated in FIG. 3. The process cartridge 30 illustrated in FIG. 3 is detachably attachable to the electrophotographic apparatus; and includes a developing roller 20 according to the present aspect, a developing blade 34, a toner container 33 that accommodates a toner 33*a*, and a development apparatus 35 having a toner supply roller 32. In addition, the process cartridge 30 illustrated in FIG. 3 is an all-in-one process cartridge which is integrated together with a photosensitive member 31, a cleaning blade 38, a container 37 for accommodating a waste toner and a charging roller 36.

Figure 4:
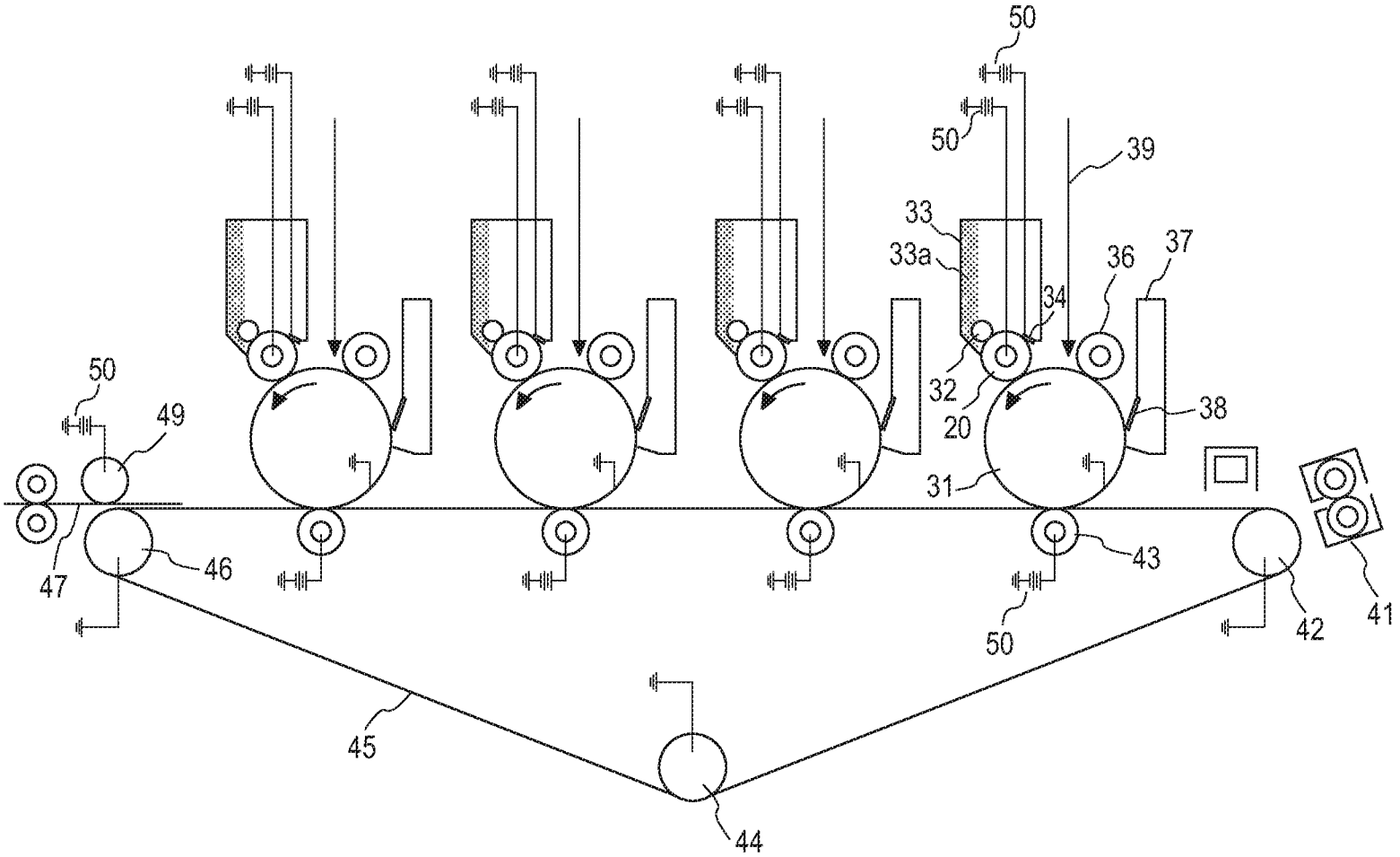
FIG. 4 illustrates a configuration diagram illustrating an electrophotographic image forming apparatus according to one aspect of the present disclosure.

An image forming apparatus according to one aspect of the present disclosure is illustrated in FIG. 4. On the image forming apparatus illustrated in FIG. 4, a developing roller 20, a toner supply roller 32, a toner container 33 that accommodates a toner 33*a*, and a development apparatus 35 having a developing blade 34 are detachably mounted. In addition, a process cartridge is detachably mounted which has a development apparatus 35, a photosensitive member 31, a cleaning blade 38, a container 37 for accommodating a waste toner and a charging roller 36. Note that the photosensitive member 31, the cleaning blade 38, the container 37 for accommodating the waste toner and the charging roller 36 may be provided in the main body of the image forming apparatus.

The photosensitive member 31 rotates in the direction of the arrow, and is uniformly charged by the charging roller 36 for charging the photosensitive member 31; and an electrostatic latent image is formed on the surface by a laser beam 39 which is an exposure unit for writing the electrostatic latent image onto the photosensitive member 31.

The electrostatic latent image is imparted with the toner 33*a* of a developer by a development apparatus 35 which is arranged in contact with the photosensitive member 31, thereby is developed, and is visualized as a toner image. The development is so-called reversal development which forms a toner image on an exposed part.

The visualized toner image on the photosensitive member 31 is transferred to paper 47 that is a recording medium, by a transfer roller 43 which is a transfer member. The paper 47 is fed into the apparatus via a feed roller 46 and an adsorption roller 49, and is conveyed between the photosensitive member 31 and the transfer roller 43, by a transfer conveyance belt 45 having an endless belt shape. The transfer conveyance belt 45 is operated by a driven roller 46, a driving roller 42 and a tension roller 44. A voltage is applied to the transfer roller 43 and the adsorption roller 49, from a bias power source 50.

The paper 47 to which the toner image has been transferred is subjected to a fixing process in the fixing apparatus 41, and is discharged to the outside of the apparatus; and the printing operation ends.

On the other hand, a transfer residual toner that has not been transferred and has remained on the photosensitive member 31 is scraped off by the cleaning blade 38 which is a cleaning member for cleaning the surface of the photosensitive member 31, and is stored in an accommodating container 37 for a waste toner. The cleaned photosensitive member 31 repeats the above operation.

The abutting pressure of the cleaning blade 38 can be reduced by reducing an encroaching amount of the cleaning blade 38 against the photosensitive member 31.

The development apparatus 35 includes the toner container 33 which accommodates the toner 33*a* as a one-component toner, and the developing roller 20 that is located at the aperture in the toner container 33, which extends in the longitudinal direction, is installed to face the photosensitive member 31, and functions as a toner carrier. The development apparatus 35 develops and visualizes the electrostatic latent image on the photosensitive member 31.

In addition, as the developing blade 34, members are used such as, for example, a member in which a rubber elastic body is fixed to a metal plate made from a metal; a member which has a spring property like a thin plate of SUS or phosphor bronze, or a member in which a resin or rubber is laminated on the surface thereof.

In addition, a potential difference is provided between the developing blade 34 and the developing roller 20, and thereby the toner layer on the developing roller 1 can be controlled. For this purpose, the developing blade 34 preferably has electro-conductivity. In addition, a voltage is applied to the developing roller 20 and the developing blade 34 from the bias power source 50, and it is preferable that the voltage to be applied to the developing blade 34 is different from the voltage to be applied to the developing roller 20, by 0V to approximately −300V.

The development process in the development apparatus 35 will be described below.

The toner 33*a* is applied onto the developing roller 20 by the toner supply roller 32 which is rotatably supported. The toner 33*a* which has been applied on the developing roller 20 is rubbed against the developing blade 34 by the rotation of the developing roller 20. Here, the developing roller 20 is uniformly coated with the toner 33*a* on the developing roller 20, by a bias which has been applied to the developing blade 34. The developing roller 20 comes in contact with the photosensitive member 31 while rotating, develops the electrostatic latent image which has been formed on the outer surface of the photosensitive member 31 by the toner 33*a* with which the developing roller 20 is coated, and thereby forms a toner image.

As the toner supply roller 32, rollers can be used such as, for example, a roller provided with a layer which has a porous foamed structure, or a roller provided with a fur brush, in which fibers of rayon, polyamide or the like are planted on a substrate. These rollers are preferable because of being excellent in functions of supplying the toner 33*a* to the developing roller 20 and peeling off the undeveloped toner. In addition, as the toner supply roller 32, an elastic roller can be used, for example, in which a polyurethane foam is provided around a substrate.

According to one aspect of the present disclosure, a developing roller can be obtained that can prevent the contamination of the outer surface of the photosensitive member more adequately, even in the case where the abutting pressure of the cleaning blade against the photosensitive member has been reduced. In addition, according to another aspect of the present disclosure, a process cartridge can be obtained which contributes to the stable formation of a high-quality electrophotographic image. Furthermore, according to another aspect of the present disclosure, an electrophotographic image forming apparatus can be obtained which can form the high-quality electrophotographic image.

EXAMPLE

The developing roller and the like according to the present disclosure will be specifically described below with reference to Examples, but the developing roller and the like according to the present disclosure are not limited to only the structures embodied in these Examples. In the following description, the particle size which is denoted as "average (primary) particle size" and does not particularly describe the measurement method shows a catalog value of a supply source of the particle.

1. Manufacture of Electro-Conductive Elastic Rollers (1-1. Manufacture of Electro-Conductive Elastic Roller 1)

A substrate was prepared that had a primer (trade name: DY35-051, produced by Dow Corning Toray Co., Ltd.) which was applied to a shaft core made from SUS304 having an outer diameter of 6 mm and a length of 260 mm, and was baked. This substrate was placed in a mold, and an addition type silicone rubber composition in which the materials shown in the following Table 1 were mixed was injected into a cavity that was formed in the mold. Subsequently, the mold was heated, thereby the addition type silicone rubber composition was heated at a temperature of 150° C. for 15 minutes and was cured; and the resultant substrate was demolded. After that, the substrate was further heated at a temperature of 180° C. for 1 hour, and the curing reaction was completed. Thus, an electro-conductive elastic roller 1 was manufactured which had an electro-conductive elastic layer having a thickness of 2.00 mm on the outer circumference of the substrate.

TABLE 1

| Material | Parts by mass |
|---|---|
| Liquid silicone rubber material (trade name: SE6724A/B, manufactured by Dow Corning Toray Co., Ltd.) | 100 |
| Carbon black (trade name: Toka Black #7360SB, manufactured by Tokai Carbon Co., Ltd.) | 20 |
| Platinum catalyst | 0.1 |

(1-2. Manufacture of Electro-Conductive Elastic Roller 2)

A substrate was prepared that had a primer (trade name: DY35-051, produced by Dow Corning Toray Co., Ltd.) which was applied to a shaft core made from SUS304 having an outer diameter of 6 mm and a length of 260 mm, and was baked. Materials shown in the following Table 2 were kneaded, and an unvulcanized rubber composition was prepared.

Next, a cross head extruder was prepared which had a supply mechanism for the substrate and a discharging mechanism for the unvulcanized rubber composition, a die having an inner diameter of 10.1 mm was attached to the cross head, the temperatures of the extruder and the cross head were set at 30° C., and the conveyance speed of the substrate was adjusted to 60 mm/sec. Under these conditions, the unvulcanized rubber composition was supplied from the extruder, and in the cross head, the outer circumference of the substrate was covered with the unvulcanized rubber composition as an elastic layer; and an unvulcanized rubber roller 2 was obtained. Next, the above unvulcanized rubber roller was charged into a hot air vulcanizing furnace of 170° C., and was heated for 15 minutes. After that, the resultant rubber roller was polished with the use of a rotary polisher (trade name: LEO-600-F4L-BME, manufactured by Mizuguchi Seisakusho) which used a grindstone of GC80, and an electro-conductive elastic roller 2 was manufactured which had an electro-conductive elastic layer with a thickness of 2.0 mm on the outer circumference of the shaft core.

TABLE 2

| Material | Parts by mass |
|---|---|
| Millable silicone rubber material (trade name: TSE270-4U, manufactured by Momentive Performance Materials Japan) | 100 |
| Carbon black (trade name: Toka Black #7360SB, manufactured by Tokai Carbon Co., Ltd.) | 10 |
| Hardener (trade name: TC8, manufactured by Momentive Performance Materials Japan) | 0.5 |

2. Preparation of Surface Layer Coating Liquid (2-1. Production of Isocyanate-Terminated Prepolymer B-1)

Under a nitrogen atmosphere, 100 parts by mass of a polyether polyol (trade name: PTG-L3500, produced by Hodogaya Chemical Industries) was gradually added dropwise to 25 parts by mass of polymeric MDI (trade name: Millionate MR200, produced by Nippon Polyurethane Industry Co., Ltd.) in a reaction vessel. At this time, the temperature inside the reaction vessel was kept at 65° C. After the completion of the dropwise addition, the mixture was subjected to a reaction at 65° C. for 2 hours. The obtained reaction mixture was cooled to room temperature, and an isocyanate-terminated prepolymer B-1 was obtained of which the content of the isocyanate group was 4.3% by mass.

(2-2. Preparation of Surface Layer Coating Liquid X-1)

Next, the raw materials of the composition shown in the following Table 3 were mixed.

TABLE 3

| Material | Parts by mass |
|---|---|
| Isocyanate-terminated prepolymer B-1 | 58 |
| Polyether polyol A-1 (trade name: PTMG2000, manufactured by Mitsubishi Chemical Corporation) | 42 |
| Carbon black C-1 (trade name: MA100, manufactured by Mitsubishi Chemical Corporation) | 25 |
| First resin particle D-1 (trade name: CE400 transparent, polyurethane particle, manufactured by Negami Chemical Industrial Co., Ltd.) | 33 |
| Second resin particle E-1 (trade name: C800 transparent, polyurethane particle, manufactured by Negami Chemical Industrial Co., Ltd.) | 77 |

Next, methyl ethyl ketone (MEK) was added so that the solid content of the above raw material became 30% by mass, and a mixed solution 1 was obtained. Furthermore, 1250 parts by mass of the mixed solution and 200 parts by mass of glass beads having an average particle size of 0.8 mm were charged into a glass bottle having an internal volume of 450 mL, and were dispersed with the use of a paint shaker (manufactured by Toyo Seiki kogyo Co., Ltd.), for 3 hours. After that, the glass beads were removed therefrom, and a surface layer coating liquid X-1 for forming the surface layer was obtained.

(2-3. Preparation of Surface Layer Coating Liquids X-2 to X-32 and J-1 to J-9)

Surface layer coating liquids X-2 to X-32 and J-1 to J-9 were prepared in the same manner as that for the surface layer coating liquid X-1, except that the formulation was changed to those described in Table 4. In addition, the details of the raw materials described by symbols in the column of "type" in Table 4 are described in Tables 5-1 and 5-2.

Note that a method for preparing the isocyanate (isocyanate-terminated prepolymer) "B-1" in Tables 5-1 and 5-2 was described above. In addition, methods for preparing isocyanate "B-2" and urethane particles D-2, D-3, D-5, D-6, D-7, D-8, D-12, D-13, E-6 and E-7 are described after Table 5-2.

TABLE 4

| Surface layer | Polyol | | Isocyanate | | Electro-conductive agent | | First resin particle | | Second resin particle | |
|---|---|---|---|---|---|---|---|---|---|---|
| coating liquid | Type | Parts by mass | Type | Parts by mass | Type | Parts by mass | Type | Parts by mass | Type | Parts by mass |
| X-1 | A-1 | 42 | B-1 | 58 | C-1 | 25 | D-1 | 33 | E-1 | 77 |
| X-2 | A-1 | 42 | B-1 | 58 | C-1 | 25 | D-2 | 4 | E-2 | 20 |
| X-3 | A-1 | 42 | B-1 | 58 | C-1 | 25 | D-2 | 7 | E-3 | 117 |
| X-4 | A-1 | 42 | B-1 | 58 | C-1 | 25 | D-3 | 46 | E-2 | 28 |
| X-5 | A-1 | 42 | B-1 | 58 | C-1 | 25 | D-3 | 110 | E-3 | 220 |
| X-6 | A-1 | 42 | B-1 | 58 | C-1 | 25 | D-4 | 18 | E-3 | 55 |
| X-7 | A-1 | 42 | B-1 | 58 | C-1 | 25 | D-2 | 4 | E-4 | 13 |
| X-8 | A-1 | 42 | B-1 | 58 | C-1 | 25 | D-2 | 13 | E-4 | 41 |
| X-9 | A-1 | 42 | B-1 | 58 | C-1 | 25 | D-2 | 4 | E-5 | 20 |
| X-10 | A-1 | 42 | B-1 | 58 | C-1 | 25 | D-2 | 13 | E-5 | 41 |
| X-11 | A-4 | 6 | B-1 | 94 | C-1 | 25 | D-2 | 4 | E-7 | 29 |
| X-12 | A-4 | 6 | B-1 | 94 | C-1 | 25 | D-2 | 13 | E-6 | 41 |
| X-13 | A-3 | 42 | B-2 | 58 | C-1 | 25 | D-2 | 4 | E-6 | 20 |
| X-14 | A-3 | 42 | B-2 | 58 | C-1 | 25 | D-2 | 13 | E-6 | 41 |
| X-15 | A-2 | 73 | B-1 | 27 | C-1 | 25 | D-2 | 4 | E-6 | 20 |
| X-16 | A-2 | 73 | B-1 | 27 | C-1 | 25 | D-2 | 13 | E-6 | 41 |
| X-17 | A-3 | 42 | B-2 | 58 | C-1 | 25 | D-2 | 4 | E-6 | 20 |
| X-18 | A-3 | 42 | B-2 | 58 | C-1 | 25 | D-2 | 4 | E-2 | 20 |
| X-19 | A-3 | 42 | B-2 | 58 | C-1 | 25 | D-3 | 55 | E-3 | 110 |
| X-20 | A-3 | 42 | B-2 | 58 | C-1 | 25 | D-3 | 55 | E-3 | 110 |
| X-21 | A-1 | 42 | B-1 | 58 | C-1 | 25 | D-2 | 13 | E-2 | 41 |
| X-22 | A-1 | 42 | B-1 | 58 | C-1 | 25 | D-2 | 17 | E-3 | 85 |
| X-23 | A-1 | 42 | B-1 | 58 | C-1 | 25 | D-3 | 40 | E-2 | 50 |

TABLE 4-continued

| Surface layer coating liquid | Polyol Type | Polyol Parts by mass | Isocyanate Type | Isocyanate Parts by mass | Electro-conductive agent Type | Electro-conductive agent Parts by mass | First resin particle Type | First resin particle Parts by mass | Second resin particle Type | Second resin particle Parts by mass |
|---|---|---|---|---|---|---|---|---|---|---|
| X-24 | A-1 | 42 | B-1 | 58 | C-1 | 25 | D-3 | 55 | E-3 | 110 |
| X-25 | A-1 | 42 | B-1 | 58 | C-1 | 25 | D-5 | 13 | E-2 | 41 |
| X-26 | A-1 | 42 | B-1 | 58 | C-1 | 25 | D-5 | 17 | E-3 | 85 |
| X-27 | A-1 | 42 | B-1 | 58 | C-1 | 25 | D-6 | 40 | E-2 | 50 |
| X-28 | A-1 | 42 | B-1 | 58 | C-1 | 25 | D-6 | 55 | E-3 | 110 |
| X-29 | A-1 | 42 | B-1 | 58 | C-1 | 25 | D-7 | 13 | E-2 | 41 |
| X-30 | A-1 | 42 | B-1 | 58 | C-1 | 25 | D-7 | 17 | E-3 | 85 |
| X-31 | A-1 | 42 | B-1 | 58 | C-1 | 25 | D-8 | 40 | E-2 | 50 |
| X-32 | A-1 | 42 | B-1 | 58 | C-1 | 25 | D-8 | 55 | E-3 | 110 |
| J-1 | A-4 | 6 | B-1 | 94 | C-1 | 25 | D-9 | 33 | E-1 | 77 |
| J-2 | A-4 | 6 | B-1 | 94 | C-1 | 25 | D-10 | 33 | E-1 | 77 |
| J-3 | A-4 | 6 | B-1 | 94 | C-1 | 25 | D-11 | 33 | E-4 | 77 |
| J-4 | A-4 | 6 | B-1 | 94 | C-1 | 25 | D-7 | 4 | E-8 | 20 |
| J-5 | A-4 | 6 | B-1 | 94 | C-1 | 25 | D-12 | 1 | E-1 | 20 |
| J-6 | A-4 | 6 | B-1 | 94 | C-1 | 25 | D-13 | 60 | E-1 | 30 |
| J-7 | A-4 | 6 | B-1 | 94 | C-1 | 25 | D-2 | 3 | — | — |
| J-8 | A-4 | 6 | B-1 | 94 | C-1 | 25 | D-2 | 8 | E-9 | 144 |
| J-9 | A-4 | 15 | B-3 | 85 | C-1 | 25 | D-2 | 4 | E-6 | 20 |

TABLE 5-1

| | | Name of compound |
|---|---|---|
| Polyol | A-1 | Polyether polyol (hydroxyl value: 56.1 mgKOH/g, trade name: PTMG2000, manufactured by Mitsubishi Chemical Corporation) |
| | A-2 | Polyether polyol (hydroxyl value: 17.5 mgKOH/g, trade name: PTG-L3500, manufactured by Hodogaya Chemical Co., Ltd.) |
| | A-3 | Polycarbonate polyol (hydroxyl value: 55.7 mgKOH/g, trade name: Duranol T5652, manufactured by Asahi Kasei Corporation) |
| | A-4 | Amine-based polyol (hydroxyl value: 701 mgKOH/g, trade name: NP-400, manufactured by Sanyo Chemical Industries, Ltd.) |
| Isocyanate | B-1 | Polyether polyol (NCO content: 4.3%, trade name: PTG-L3500, manufactured by Hodogaya Chemical Co., Ltd.)/ Polymeric MDI (trade name: Millionate MR200, manufactured by Tosoh Corporation) |
| | B-2 | Polycarbonate polyol (NCO content: 4.3%, trade name: Duranol T5652, manufactured by Asahi Kasei Corporation)/ polymeric MDI (trade name: Millionate MR200, manufactured by Tosoh Corporation) |
| | B-3 | Polyester-modified isocyanate (NCO content: 13.2%, trade name: Coronate L, manufactured by Tosoh Corporation) |
| Electro-conductive agent | C-1 | Carbon black (trade name: MA100, average primary particle size 24 nm, manufactured by Mitsubishi Chemical Corporation) |

TABLE 5-2

| | | Name of compound |
|---|---|---|
| First resin particle | D-1 | Urethane particle (trade name: Art Pearl CE400 transparent, average particle size 15.0 μm, manufactured by Negami Chemical Industrial Co., Ltd.) |
| | D-2 | Urethane particle (A-4 × B-1, average particle size 13.0 μm) |
| | D-3 | Urethane particle (A-4 × B-1, average particle size 20.0 μm) |
| | D-4 | Urethane particle (trade name: Art Pearl U600 transparent, average particle size 10.0 μm, manufactured by Negami Chemical Industrial Co., Ltd.) |
| | D-5 | Urethane particle (classified product) (trade name: Art Pearl CE400 transparent, average particle size 13.0 μm, manufactured by Negami Chemical Industrial Co., Ltd.) |
| | D-6 | Urethane particle (classified product) (trade name: Art Pearl CE400 transparent, average particle size 20.0 μm, manufactured by Negami Chemical Industrial Co., Ltd.) |
| | D-7 | Urethane particle (classified product) (trade name: Art Pearl U400 transparent, average particle size 13.0 μm, manufactured by Negami Chemical Industrial Co., Ltd.) |
| | D-8 | Urethane particle (classified product) (trade name: Art Pearl U400 transparent, average particle size 20.0 μm, manufactured by Negami Chemical Industrial Co., Ltd.) |
| | D-9 | Acrylic particle (trade name: Chemisnow MX-1500H, average particle size 15.0 μm, manufactured by Soken Chemical & Engineering Co., Ltd.) |
| | D-10 | Acrylic particle (trade name: Techpolymer AFX-15, average particle size 15.0 μm, manufactured by Sekisui Plastics Co., Ltd.) |
| | D-11 | Urethane particle (trade name: Art Pearl C400 transparent, average particle size 15.0 μm, manufactured by Negami Chemical Industrial Co.,Ltd.) |
| | D-12 | Urethane particle (A-1 × B-2, average particle size 8.0 μm) |
| | D-13 | Urethane particle (A-1 × B-2, average particle size 30.0 μm) |

TABLE 5-2-continued

| | | Name of compound |
|---|---|---|
| Second resin particle | E-1 | Urethane particle (trade name: Art Pearl C800 transparent, average particle size 6.0 μm, manufactured by Negami Chemical Industrial Co., Ltd.) |
| | E-2 | Urethane particle (classified product) (trade name: Art Pearl C800 transparent, average particle size 8.0 μm, manufactured by Negami Chemical Industrial Co., Ltd.) |
| | E-3 | Urethane particle (trade name: Art Pearl C1000 transparent, average particle size 3.0 μm, manufactured by Negami Chemical Industrial Co., Ltd.) |
| | E-4 | Silicone particle (trade name: KMP-600, average particle size 5.0 μm, manufactured by Shin-Etsu Chemical Co., Ltd.) |
| | E-5 | Urethane particle (trade name: Art Pearl JB800 transparent, average particle size 6.0 μm, manufactured by Negami Chemical Industrial Co., Ltd.) |
| | E-6 | Urethane particle (A-3 × B-2, average particle size 8.0 μm) |
| | E-7 | Urethane particle (A-3 × B-2, average particle size 10.0 μm) |
| | E-8 | Acrylic particle (trade name: Chemisnow MX-500H, average particle size 5.0 μm, manufactured by Soken Chemical & Engineering Co., Ltd.) |
| | E-9 | Silicone particle (trade name: KMP-605, average particle size 2.0 μm, manufactured by Shin-Etsu Chemical Co., Ltd.) |

(2-4-1. Production of Isocyanate-Terminated Prepolymer B-2)

Under a nitrogen atmosphere, 100 parts by mass of a polycarbonate polyol (trade name: Duranol T5652, produced by Asahi Kasei Chemicals) was gradually added dropwise to 33 parts by mass of polymeric MDI (trade name: Millionate MR200, produced by Nippon Polyurethane Industry Co., Ltd.) in a reaction vessel. At this time, the temperature inside the reaction vessel was kept at 65° C. After the completion of the dropwise addition, the mixture was subjected to a reaction at 65° C. for 2 hours. The obtained reaction mixture was cooled to room temperature, and an isocyanate-terminated prepolymer B-2 was obtained of which the content of the isocyanate group was 4.3% by mass.

(2-4-2. Production of Urethane Particle D-2)

Into water containing a suspension stabilizer (calcium phosphate), 3 parts by mass of an amine-based polyol A-4 and 97 parts by mass of an isocyanate-terminated prepolymer B-1 were charged, the mixture was stirred, and a suspension was prepared. Next, the suspension was heated to start a reaction, and was sufficiently reacted to produce a urethane particle therein. After that, the urethane particle was collected by solid-liquid separation, the suspension stabilizer was removed therefrom by washing, and the urethane particle was dried. The obtained urethane particles were classified with the use of an air classifier (trade name: EJ-L-3, manufactured by Nittetsu Mining Co., Ltd.). The volume average particle diameter (median diameter) of the urethane particles was measured with a particle size distribution analyzer (trade name: Coulter Multisizer II, manufactured by Beckman Coulter, Inc.), and as a result, was 13.0 μm. The urethane particle was determined to be urethane particle D-2.

(2-4-3. Production of Urethane Particles D-3, D-12 and D-13)

Urethane particles D-3 (volume average particle diameter of 20.0 μm), D-12 (volume average particle diameter of 8.0 μm) and D-13 (volume average particle diameter of 30.0 μm) were produced in the same manner as that in the production of the urethane particle D-2 in 2-4-2, except that the stirring speed of the suspension and the classification conditions of the urethane particles were changed.

(2-4-4. Production of Urethane Particles D-5 and D-6)

Urethane particles D-1 (trade name: Art Pearl CE400 transparent, volume average particle diameter of 15.0 μm, produced by Negami chemical industrial co., ltd.) were classified with the use of a wind classifier (trade name: EJ-L-3, manufactured by Nippon Mining Co., Ltd.). The volume average particle diameter (median diameter) of the urethane particles was measured with a particle size distribution analyzer (trade name: Coulter Multisizer II, manufactured by Beckman Coulter, Inc.), and as a result, was 13.0 μm. The urethane particle was determined to be urethane particle D-5. In addition, urethane particles D-6 having a volume average particle diameter of 20.0 μm were produced under changed classification conditions.

(2-4-5. Production of Urethane Particles D-7 and D-8)

Urethane particles D-7 (volume average particle diameter of 13.0 μm) and D-8 (volume average particle diameter of 20.0 μm) were produced in the same manner as that for urethane particles D-5 and D-6 in 2-4-4, except that "Art Pearl U400 Transparent" (trade name, volume average particle diameter 15.1 μm, produced by Negami chemical industrial co., ltd.) was used as urethane particles.

(2-4-6. Production of Urethane Particles E-6 and E-7)

Urethane particles E-6 (volume average particle diameter of 8.0 μm) and urethane particles E-7 (volume average particle diameter of 8.0 μm) were produced in the same manner as that for urethane particles D-2 in 2-4-2, except that the polyol was changed to 335 parts by mass of polycarbonate-based polyol A and the isocyanate was changed to 265 parts by mass of the isocyanate-terminated prepolymer B, and the stirring speed of the suspension and the classification conditions of the urethane particles were changed.

3. (Example 1; Manufacture of Developing Roller Z-1)

The electro-conductive elastic roller 1 was dipped once in the surface layer coating liquid X-1, and then was air-dried at a temperature of 23° C. for 30 minutes. Next, the roller was dried in a hot-air circulating dryer which was set at a temperature of 160° C. for 1 hour, and a developing roller Z-1 was manufactured which had a surface layer formed on the outer circumferential surface of the electro-conductive elastic roller. A dipping time period for dipping application was 9 seconds. A raising speed in the dipping application was adjusted so that an initial speed became 20 mm/sec and the final speed became 2 mm/sec, and in a period from 20 mm/sec to 2 mm/sec, the speed was changed linearly with time.

4. Evaluation of Physical Properties (Evaluation of Physical Properties 4-1. Maximum Height Roughness Rz)

The maximum height roughness Rz according to the present aspect can be measured with a laser microscope (trade name: VK-X150, manufactured by Keyence Corporation) which scans the outer surface of the surface layer of the developing roller. Firstly, the developing roller Z-1 was installed so that the vertex of the outer surface in the circumferential direction of the developing roller came directly below the lens of the laser microscope, and the axial direction of the developing roller became the longitudinal direction of the observation field of view of the laser microscope. Next, the shape of the outer surface of the surface layer was measured under the following conditions.

Mode: shape measurement expert

Measurement lens: magnification of 50

Upper and lower limits in Z axis: range in which reflected light becomes unobserved in field of view for laser Laser brightness: automatic Double scan: always perform Measurement mode: surface shape Measurement size: high definition (2048×1536)

Measurement quality: high precision

RPD: ON

Pitch: 0.13 μm

Next, the above measurement results were read out by a multi-file analysis application which was software attached to the laser microscope. The read out image was corrected in the following order.

Surface shape correction:

Correction method: quadratic surface correction, Designation method: region designation Cut level of height:

Cut level: strong

Smoothing:

Size: 7×7, Type: simple average

Next, the average value of Rz was calculated under the following conditions.

Measurement mode: "multiple line roughness"

Measurement region: horizontal line

Number of lines in circumference: 18 lines

Interval: skip 20 lines

Measurement value: average value of Rz

The above measurement was performed at 30 spots in total of 5 equally spaced spots in the axial direction of the developing roller×6 equally spaced spots in the circumferential direction thereof, and the arithmetic average value was determined to be the average value of the maximum heights Rz of the developing roller Z-1. In this way, the average value of Rz according to the present aspect is the average value of the maximum heights Rz of 540 points in total of 18 lines in a short distance×30 spots, and accordingly can express the height and the frequency of a higher protrusion on the outer surface of the surface layer. Table 7 shows the results.

(Evaluation of Physical Properties 4-2. Peak Vertex Density Spd)

The peak vertex density Spd can be obtained by the observation of the surface under a microscope in the same manner as that in the above average value of the maximum heights Rz. Firstly, the shape of the outer surface of the developing roller Z-1 was measured in the same manner as that in the above average value of the maximum heights Rz.

Next, the above measurement results were read out by a multi-file analysis application which was software attached to the laser microscope. The read out image was corrected in the same manner as that in the above average value of the maximum heights Rz.

Next, Spd was calculated under the following conditions.

Measurement mode: "surface roughness"

Measurement region: all regions

Measurement value: Spd

The above measurement was performed at 30 spots in total of 5 equally spaced spots in the axial direction of the developing roller×6 equally spaced spots in the circumferential direction thereof, and the arithmetic average value per $mm^2$ was determined to be the peak vertex density Spd of the developing roller Z-1. Table 7 shows the results.

(Evaluation of Physical Properties 4-3. Confirmation of First Protrusion and Second Protrusion)

A difference between the height of the first protrusion and the height of the second protrusion on the outer surface of the surface layer of the developing roller Z-1 can be determined by the observation of the surface under a microscope in the same manner as that in the above average value of the maximum heights Rz.

Firstly, the shape of the outer surface of the developing roller Z-1 was measured in the same manner as that in the above average value of the maximum heights Rz.

Next, the above measurement results were read out by the multi-file analysis application which was software attached to the laser microscope. The read out image was corrected in the same manner as that in the above average value of the maximum height Rz.

Next, in the measurement mode: "line roughness", a vertex of a relatively large protrusion which existed in the measurement field of view and a vertex of a relatively small protrusion which existed therein were connected by designation of two points, and the two protrusions were extracted of which the difference of heights between the vertex of the large protrusion and the vertex of the small protrusion was 5.0 μm or larger.

Next, the outer surface of the developing roller was marked so that the large protrusion and the small protrusion could be distinguished from each other. Next, the developing roller was cooled to −150° C., and a rubber slice was cut out on which such a cross section in the thickness direction of the surface layer appeared, which had passed through the vertices of two marked protrusions, with the use of a cryomicrotome (UC-6 (product name), manufactured by Leica Microsystems).

(Evaluation of Physical Properties 4-4. Elastic Modulus)

For the measurement, a scanning probe microscope (Scanning Probe Microscope, SPM) (trade name: MFP-3D-Origin, manufactured by Oxford Instruments plc) was used.

Specifically, the rubber slice prepared in the above was left in an environment at room temperature of 23° C. and a humidity of 50%, for 24 hours. Next, the rubber slice was mounted on a silicon wafer, and the silicon wafer was set on a stage of the above scanning probe microscope. Then, the cross-sectional portion of the surface layer of the rubber slice was scanned by a probe (AC160 (product name), manufactured by Olympus Corporation). For information, the conditions concerning the probe are a spring constant: 28.23 nN/nm, an impulse constant: 82.59 nm/V, and resonance frequencies: 282 kHz (first order) and 1.59 MHz (high order). In addition, as for other measurement conditions, the measurement mode for SPM was set at the AM-FM mode, the free amplitude of the probe was set at 3 V, and the amplitudes of the set point were set at 2 V (first order) and 25 mV (high order). Then, in the size of the field of view of 20 μm×20 μm, the scanning speed was set at 1 Hz, and the number of scanning points was set at 256 points vertically and 256 points horizontally.

After that, for the matrix of the surface layer, the first resin particle, the second resin particle, and the electro-conductive elastic layer, ten measurement points in a region which would be described later were designated, and a force curve was acquired in the contact mode, in each of the measurement points. For information, the conditions at the time when the force curve was obtained were the following conditions. The force curve was acquired under such conditions that a trigger value was 0.2 to 0.5 V (changed according to hardness), a distance for measuring the force curve was 500 nm, and a scanning speed was 1 Hz (speed at which the probe makes one round trip). After that, each of the force curves was subjected to fitting based on the Hertz theory. The highest value and the lowest value were removed from the obtained results; the arithmetic average of eight points was calculated, and was determined to be the elastic modulus of each of the measurement regions.

(Evaluation of Physical Properties 4-4-1. Elastic Modulus of Matrix of Surface Layer)

The elastic modulus $E_b$ of the matrix of the surface layer was measured in the following way.

The elastic modulus of the matrix of the surface layer in the region of 1.1 to 1.2 μm in the depth direction from the outer surface of the surface layer, in a cross section in the thickness direction of the surface layer of the rubber slice, was measured by the method described in above 4-4.

Next, the elastic modulus was similarly measured in the region of 1.0 μm pitch in the depth direction from the region to the vicinity of the interface with the above electro-conductive elastic layer. Note that the measurement in the contact mode was performed while avoiding the electro-conductive agent and the filler. The above measurement was performed at 9 spots in total of 3 equally spaced spots in the axial direction of the developing roller×3 equally spaced spots in the circumferential direction thereof, and the arithmetic average value was determined to be the elastic modulus $E_b$ of the matrix of the surface layer of the developing roller Z-1. Table 7 shows the results.

Elastic modulus $E_b0$ of the first region of the matrix of the surface layer: a region ranging from the outer surface of the surface layer to a depth of 0.1 μm from the outer surface of the surface layer in the cross section of the surface layer, was determined to be the first region, and the elastic modulus of the first region was measured, based on the above measurement method. Note that the measurement in the contact mode was performed while avoiding the electro-conductive agent and the filler. The above measurement was performed at 9 spots in total of 3 equally spaced spots in the axial direction of the developing roller×3 equally spaced spots in the circumferential direction thereof, and the arithmetic average value was determined to be the elastic modulus $E_b0$ of the first region of the surface layer of the developing roller Z-1. Table 7 shows the results.

Elastic modulus $E_b1$ of a second region of the matrix of the surface layer: the elastic modulus of a region ranging from 1.0 μm from the outer surface of the surface layer to a depth of 1.1 μm from the outer surface, which was obtained in the above measurement of the elastic modulus $E_b$ of the matrix of the surface layer, was determined to be elastic modulus $E_b1$ of a second region of the matrix of the surface layer. Table 7 shows the results. Here, it is preferable that $E_b0$ is 200 MPa or higher, and $E_b1$ is 10 MPa or higher and 100 MPa or lower, because then the region at which the matrix is highly hardened becomes smaller than 1 μm, and the flexibility of the surface layer is apt to be maintained. $E_b1$ is more preferably 80 MPa or lower.

(Evaluation of Physical Properties 4-4-2. Elastic Modulus of First Resin Particle)

The elastic modulus $E_1$ of the first resin particle which formed the first protrusion was measured by the following method. The elastic modulus of a region in the vicinity of the center of the particle was measured which formed the first protrusion, in the cross section in the thickness direction of the surface layer of the rubber slice, based on the above measurement method. The above measurement was performed for first protrusions in number of 45 or more in total, at 9 spots or more in total of 3 equally spaced spots or more in the axial direction of the developing roller×3 equally spaced spots or more in the circumferential direction thereof, and the arithmetic average value was calculated.

It was confirmed that the obtained arithmetic average value was 100 MPa or higher and 2000 MPa or lower; it was identified that the particle which formed the large protrusion was the first resin particle; and also the elastic modulus inside the particle was determined to be an elastic modulus $E_1$ of the first resin particle of the developing roller Z-1. Table 7 shows the results.

(Evaluation of Physical Properties 4-4-3. Elastic Modulus of Second Resin Particle)

The elastic modulus $E_2$ of the second resin particle which formed the second protrusion was measured in the following way. The elastic modulus of a region in the vicinity of the center of the particle was measured which formed the second protrusion, in the cross section in the thickness direction of the surface layer of the rubber slice, based on the above measurement method. The above measurement was performed for second protrusions in number of 45 or more in total, at 9 spots or more in total of 3 equally spaced spots or more in the axial direction of the developing roller×3 equally spaced spots or more in the circumferential direction thereof, and the arithmetic average value was calculated. It was confirmed that the obtained arithmetic average value was 2 MPa or higher and 50 MPa or lower; it was identified that the particle which formed the small protrusion was the second resin particle; and also the elastic modulus of the particle was determined to be an elastic modulus $E_2$ of the second resin particle of the developing roller Z-1. Table 7 shows the results.

(Evaluation of Physical Properties 4-4-4. Elastic Modulus of Electro-Conductive Elastic Layer)

The elastic modulus of the electro-conductive elastic layer of the developing roller Z-1 was measured by the following methods, respectively. Elastic modulus $E_e$ of electro-conductive elastic layer: the elastic modulus of the resin of the electro-conductive elastic layer of the developing roller Z-1 was measured on the cross section of the electro-conductive elastic layer, based on the above measurement method. Specifically, a region of 2.0 μm or deeper in the depth direction from the interface of the surface layer was similarly measured. Note that the measurement in the contact mode was performed while avoiding the electro-conductive agent and the filler. The above measurement was performed at 9 spots in total of 3 equally spaced spots in the axial direction of the developing roller×3 equally spaced spots in the circumferential direction thereof, and the arithmetic average value was determined to be the elastic modulus $E_e$ of the electro-conductive elastic layer of the developing roller Z-1. Table 7 shows the results.

(Evaluation of Physical Properties 4-5. Volume Average Particle Diameter $D_V$ and Volume Ratio of Resin Particles Existing in Surface Layer)

The volume average particle diameter $D_V$ of resin particles existing in the surface layer was measured by the following method. Firstly, the elastic moduli of all the resin particles existing in the cross section of the surface layer were measured, which was used in the measurement of the above elastic modulus. Next, based on the measured elastic moduli of the resin particles, particles having a high elastic modulus were classified as first resin particles, and particles having a relatively low elastic modulus were classified as second resin particles. Furthermore, from the cross-sectional area of each of the classified particles, the equivalent circle diameter Ds of the cross section of each particle was calculated. Then, assuming that each particle is a sphere and the cross section is a cross section obtained by random cutting of the sphere, the particle diameter D of the resin particle was calculated from the circle equivalent diameter Ds of the cross section, according to the following Expression (1).

$$D_S = 2 \times \int_{-\frac{D}{2}}^{\frac{D}{2}} \sqrt{\left(\frac{D}{2}\right)^2 - x^2}\, dx \qquad \text{[Expression (1)]}$$

$$D = 4/\pi \times D_S$$

The above measurement was performed for 100 or more particles in total of each of the first resin particles and the second resin particles, at 9 spots or more in total of 3 equally spaced spots or more in the axial direction of the developing roller×3 equally spaced spots or more in the circumferential direction thereof. With the use of the D of each particle, which was obtained in this way, and of the volume value which was converted with the use of $4/3\times\pi\times(D/2)^3$, the average volume particle sizes (median diameter) $D_{V1}$ and $D_{V2}$ of the first resin particles and the second resin particles were calculated.

It can be understood from Tables 5-2, 7 and 8 that the volume average particle diameters in the surface layer have an adequate correlation with the volume average particle diameters of the particles of the raw materials (hereinafter also simply referred to as average particle size).

In addition, a volume ratio between the first resin particles and the second resin particles in the surface layer is the same as an area ratio which was obtained from the cross-sectional area, and accordingly was calculated with the use of the cross section at the time of the above measurement. Specifically, all the resin particles existing in the cross section of the surface layer were divided into first resin particles and second resin particles according to the elastic modulus, and then the area ratio between the first resin particles and the second resin particles was calculated which constituted the cross sectional area of the surface layer. This measurement was performed at 9 spots or more in total of 3 equally spaced spots or more in the axial direction of the developing roller×3 equally spaced spots or more in the circumferential direction thereof, and the arithmetic average values were determined to be volume ratios $V_1$ and $V_2$ of the first resin particles and the second resin particles.

(Evaluation of Physical Properties 4-6. Layer Thickness of Surface Layer)

The layer thickness in the depth direction from the outer surface of the surface layer according to the present aspect was measured by the following method.

Firstly, a rubber slice including a cross section in the depth direction of the surface layer was cut out from the outer surface thereof, with a cutter knife. Next, the cross section was observed with the use of an optical microscope, and a distance from a local minimum point of a concave portion between the protrusions which existed on the outer surface of the surface layer, to the interface between the surface layer and the electro-conductive elastic layer was measured. The above measurement was performed at 10 points at each of 9 or more spots in total of 3 equally spaced spots or more in the axial direction of the developing roller×3 equally spaced spots or more in the circumferential direction thereof, and the arithmetic average value was determined to be the layer thickness of the surface layer.

5. Evaluation of Image

An encroaching amount of the cleaning blade of the process cartridge (trade name: HP410X High Yield Magenta Original Jet Toner Cartridge (CF413X), manufactured by Hewlett-Packard Company) onto the photosensitive member was reduced, for the purpose of lowering the torque of the process cartridge. Specifically, the encroaching amount was reduced by an operation of cutting the seat surface by 1 mm, on which the cleaning blade was mounted. Thereby, a torque of the process cartridge becomes low, but on the other hand, the outer surface of the photosensitive member is apt to be contaminated by the deposition of the toner external additive component and the fusion bonding of the toner. Next, the manufactured developing roller Z-1 was incorporated into the process cartridge, and the process cartridge was charged in a laser beam printer (trade name: Color Laser Jet Pro M452dw, manufactured by Hewlett-Packard Company) which was an image forming apparatus.

(Evaluation of Image 5-1. Granularity in One-Dot Image)

The above cartridge was subjected to aging in an environment of a low temperature and low humidity (temperature of 15° C. and relative humidity of 10%) for 24 hours or longer.

After the above aging, in the same environment, a one-dot image (an image in which a pattern is repeated in which one dot among four dots has a density of 100% and the three dots have a density of 0%) was output on one sheet of A4 paper. The granularity (roughness) in the obtained one-dot image was visually evaluated. The evaluation criteria for the granularity in the one-dot image are as follows. The results are shown in Tables 10, 11 and 18 as "granularity in one-dot image".

Rank A: In one-dot image, there is no roughness, and granularity is very adequate.

Rank B: In one-dot image, roughness is very slight, and granularity is adequate.

Rank C: In one-dot image, roughness is slight.

Rank D: In one-dot image, there is roughness, and granularity is poor.

(Image Evaluation 5-2. Decrease of Density of One-Dot Image)

After the evaluation of image in 5-1, under the same environment, an image having a printing rate of 0.5% was output on 100,000 sheets of A4 paper, and then the one-dot image was output again. Next, the density of the one-dot image which was obtained in the evaluation of image in 5-1 and the density of the one-dot image obtained after 100,000 sheets were output were measured with the use of a spectral densitometer (trade name: 508, manufactured by Xrite Inc.), and a difference between densities before and after output of 100,000 sheets (density before output-density after output) was determined. The evaluation criteria for the difference of image density are as follows. The results are shown in Tables 10, 11 and 18 as "Decrease of density of one-dot image".

Rank A: Difference of image density is smaller than 0.05, and change of image density is very small.

Rank B: Difference of image density is 0.05 or larger and smaller than 0.10.

Rank C: Difference of image density is 0.10 or larger and smaller than 0.20.

Rank D: Difference of image density is 0.20 or larger, and change of image density is large.

(Evaluation of Image 5-3. White Spot)

A process cartridge having the same structure as that in the evaluations of image 5-1 and 5-2 was prepared, and was subjected to aging in an environment of a high-temperature and high-quality (temperature of 30° C., relative humidity of 80%) for 24 hours or longer. After the above aging, under the same environment, an image having a printing rate of 0.5% was output onto 100,000 sheets of A4 paper, and then a solid black image (image having a density of 100% on whole surface) was output. The presence or absence of a white spot (white dot having a diameter of 300 μm or larger) in the obtained image was visually evaluated. The evaluation criteria for the granularity in the one-dot image are as follows. The results are shown in Tables 10, 11 and 18 as "White spot".

Rank A: White spot does not exist.

Rank B: White spots exist in amount of less than 10 in one image.

Rank C: White spots exist in amount of 10 or more and less than 20 in one image.

Rank D: White spots exist in amount of 20 or more in one image.

5. (Examples 2 to 32 and Comparative Examples 1 to 9; Manufacture of Developing Rollers Z-2 to Z-32 and K-1 to K-9)

Developing rollers Z-2 to Z-32 of Examples 2 to 32 and developing rollers K-1 to K-9 of Comparative Examples 1 to 9 were manufactured in the same manner as that in Example 1, except that the electro-conductive elastic layer roller and the surface layer coating liquid described in Table 6 were used. In addition, as for the developing rollers Z18 to Z20 of Examples 18 to 20, a concentration of the solid content in the surface layer coating liquid was appropriately adjusted in order to change the layer thickness of the surface layer.

TABLE 6

| | Developing roller | Electro-conductive elastic layer roller No. | Surface layer coating liquid No. |
|---|---|---|---|
| Example 1 | Z-1 | 1 | X-1 |
| Example 2 | Z-2 | 1 | X-2 |
| Example 3 | Z-3 | 1 | X-3 |
| Example 4 | Z-4 | 1 | X-4 |
| Example 5 | Z-5 | 1 | X-5 |
| Example 6 | Z-6 | 1 | X-6 |
| Example 7 | Z-7 | 1 | X-7 |
| Example 8 | Z-8 | 1 | X-8 |
| Example 9 | Z-9 | 1 | X-9 |
| Example 10 | Z-10 | 1 | X-10 |

TABLE 6-continued

| | Developing roller | Electro-conductive elastic layer roller No. | Surface layer coating liquid No. |
|---|---|---|---|
| Example 11 | Z-11 | 1 | X-11 |
| Example 12 | Z-12 | 1 | X-12 |
| Example 13 | Z-13 | 1 | X-13 |
| Example 14 | Z-14 | 1 | X-14 |
| Example 15 | Z-15 | 1 | X-15 |
| Example 16 | Z-16 | 1 | X-16 |
| Example 17 | Z-17 | 2 | X-17 |
| Example 18 | Z-18 | 1 | X-18 |
| Example 19 | Z-19 | 1 | X-19 |
| Example 20 | Z-20 | 1 | X-20 |
| Example 21 | Z-21 | 1 | X-21 |
| Example 22 | Z-22 | 1 | X-22 |
| Example 23 | Z-23 | 1 | X-23 |
| Example 24 | Z-24 | 1 | X-24 |
| Example 25 | Z-25 | 1 | X-25 |
| Example 26 | Z-26 | 1 | X-26 |
| Example 27 | Z-27 | 1 | X-27 |
| Example 28 | Z-28 | 1 | X-28 |
| Example 29 | Z-29 | 1 | X-29 |
| Example 30 | Z-30 | 1 | X-30 |
| Example 31 | Z-31 | 1 | X-31 |
| Example 32 | Z-32 | 1 | X-32 |
| Comparative Example 1 | K-1 | 1 | J-1 |
| Comparative Example 2 | K-2 | 1 | J-2 |
| Comparative Example 3 | K-3 | 1 | J-3 |
| Comparative Example 4 | K-4 | 1 | J-4 |
| Comparative Example 5 | K-5 | 1 | J-5 |
| Comparative Example 6 | K-6 | 1 | J-6 |
| Comparative Example 7 | K-7 | 1 | J-7 |
| Comparative Example 8 | K-8 | 1 | J-8 |
| Comparative Example 9 | K-9 | 1 | J-9 |

Next, physical properties and images of the manufactured developing rollers Z-2 to Z-32 of Examples 2 to 32 and the developing rollers K-1 to K-9 of Comparative Examples 1 to 9 were evaluated in the same manner as that in Example 1. The results are shown in Table 7 to Table 11.

In addition, in the developing rollers of Comparative Examples 1 to 4 and 6 to 9, particles of which the volume average particle diameter in the surface layer was larger than 10 μm were determined to be the first resin particle, and particles of which the volume average particle diameter was 10 μm or smaller were determined to be the second resin particle, and the measurement values of the elastic modulus and the volume ratio of each of the resin particles were described in Table 9. Furthermore, in the developing roller of Comparative Example 5, the resin particles of which the volume average particle diameter that was classified by the elastic modulus was relatively large were determined to be the first resin particle, and the resin particles of which the volume average particle diameter was relatively small were determined to be the second resin particle, and the measurement values of the elastic modulus and the volume ratio of each of the resin particles were described in Table 9.

TABLE 7

| | | Electro-conductive elastic layer | Binder resin | | | First resin particle | | | Second resin particle | | | | | |
|---|---|---|---|---|---|---|---|---|---|---|---|---|---|---|
| Example | Developing roller | Elastic modulus (MPa) $E_e$ | Elastic modulus (MPa) $E_b0$ | $E_b1$ | $E_b$ | Elastic modulus (MPa) $E_1$ | Dv1 (μm) | V1 | Elastic modulus (MPa) $E_2$ | Dv2 (μm) | V2 | Film thickness of surface layer (μm) | Average value of Rz (μm) | Spd (1/mm$^2$) |
| Example 1 | Z-1 | 1 | 20 | 22 | 21 | 1000 | 14.9 | 15% | 31 | 6.0 | 35% | 11 | 10.1 | 2.0.E+04 |
| Example 2 | Z-2 | 1 | 22 | 21 | 22 | 100 | 12.9 | 3% | 30 | 7.9 | 15% | 11 | 6.0 | 5.0.E+03 |

TABLE 7-continued

| Example | Developing roller | Electro-conductive elastic layer Elastic modulus (MPa) $E_e$ | Binder resin Elastic modulus (MPa) $E_b0$ | $E_b1$ | $E_b$ | First resin particle Elastic modulus (MPa) $E_1$ | Dv1 (μm) | V1 | Second resin particle Elastic modulus (MPa) $E_2$ | Dv2 (μm) | V2 | Film thickness of surface layer (μm) | Average value of Rz (μm) | Spd (1/mm$^2$) |
|---|---|---|---|---|---|---|---|---|---|---|---|---|---|---|
| Example 3 | Z-3 | 1 | 21 | 21 | 22 | 106 | 13.0 | 3% | 31 | 3.0 | 50% | 11 | 6.1 | 4.9.E+04 |
| Example 4 | Z-4 | 1 | 21 | 21 | 21 | 106 | 20.0 | 25% | 30 | 8.0 | 15% | 10 | 17.0 | 5.1.E+03 |
| Example 5 | Z-5 | 1 | 22 | 21 | 21 | 101 | 19.9 | 25% | 33 | 3.0 | 50% | 11 | 18.0 | 5.0.E+04 |
| Example 6 | Z-6 | 1 | 21 | 21 | 20 | 2000 | 10.0 | 10% | 32 | 3.0 | 30% | 11 | 7.5 | 2.7.E+04 |
| Example 7 | Z-7 | 1 | 20 | 21 | 21 | 107 | 13.0 | 3% | 2 | 5.0 | 10% | 10 | 6.0 | 7.9.E+03 |
| Example 8 | Z-8 | 1 | 21 | 20 | 21 | 106 | 12.9 | 8% | 2 | 5.0 | 25% | 10 | 8.1 | 1.5.E+04 |
| Example 9 | Z-9 | 1 | 20 | 20 | 21 | 110 | 12.9 | 3% | 3 | 6.0 | 15% | 11 | 6.0 | 8.6.E+03 |
| Example 10 | Z-10 | 1 | 22 | 21 | 21 | 107 | 12.9 | 8% | 3 | 6.0 | 25% | 10 | 8.0 | 1.2.E+04 |
| Example 11 | Z-11 | 1 | 100 | 104 | 109 | 104 | 13.0 | 3% | 51 | 10.0 | 20% | 10 | 6.0 | 6.5.E+03 |
| Example 12 | Z-12 | 1 | 99 | 107 | 107 | 103 | 12.9 | 8% | 51 | 8.0 | 25% | 10 | 6.8 | 9.3.E+03 |
| Example 13 | Z-13 | 1 | 53 | 54 | 51 | 110 | 12.9 | 3% | 53 | 8.0 | 15% | 10 | 6.0 | 6.5.E+03 |
| Example 14 | Z-14 | 1 | 53 | 51 | 51 | 109 | 13.0 | 8% | 50 | 7.9 | 25% | 10 | 8.2 | 9.3.E+03 |
| Example 15 | Z-15 | 1 | 11 | 10 | 10 | 102 | 13.0 | 3% | 53 | 8.0 | 15% | 11 | 6.0 | 6.5.E+03 |
| Example 16 | Z-16 | 1 | 11 | 10 | 10 | 105 | 13.0 | 8% | 51 | 8.0 | 25% | 11 | 8.2 | 9.3.E+03 |
| Example 17 | Z-17 | 10 | 52 | 50 | 50 | 106 | 12.9 | 3% | 52 | 8.0 | 15% | 10 | 6.0 | 6.5.E+03 |
| Example 18 | Z-18 | 1 | 51 | 53 | 51 | 104 | 12.9 | 3% | 32 | 8.0 | 15% | 4 | 8.0 | 6.5.E+03 |
| Example 19 | Z-19 | 1 | 49 | 53 | 51 | 103 | 19.9 | 20% | 32 | 3.0 | 40% | 30 | 16.0 | 3.2.E+04 |
| Example 20 | Z-20 | 1 | 50 | 54 | 54 | 108 | 20.0 | 20% | 31 | 3.0 | 40% | 100 | 16.0 | 3.2.E+04 |
| Example 21 | Z-21 | 1 | 22 | 21 | 21 | 110 | 12.9 | 8% | 32 | 8.0 | 25% | 11 | 8.0 | 1.0.E+04 |
| Example 22 | Z-22 | 1 | 22 | 22 | 22 | 107 | 13.0 | 8% | 30 | 3.0 | 40% | 11 | 8.1 | 3.5.E+04 |
| Example 23 | Z-23 | 1 | 21 | 21 | 20 | 103 | 19.8 | 20% | 33 | 7.9 | 25% | 11 | 15.1 | 1.0.E+04 |
| Example 24 | Z-24 | 1 | 20 | 20 | 21 | 104 | 19.8 | 20% | 33 | 3.0 | 40% | 11 | 16.7 | 3.5.E+04 |
| Example 25 | Z-25 | 1 | 22 | 22 | 21 | 1067 | 13.0 | 8% | 31 | 8.0 | 25% | 10 | 8.1 | 1.0.E+04 |

TABLE 8

| Example | Developing roller | Electro-conductive elastic layer Elastic modulus (MPa) $E_e$ | Binder resin Elastic modulus (MPa) $E_b0$ | $E_b1$ | $E_b$ | First resin particle Elastic modulus (MPa) $E_1$ | Dv1 (μm) | V1 | Second resin particle Elastic modulus (MPa) $E_2$ | Dv2 (μm) | V2 | Film thickness of surface layer (μm) | Average value of Rz (μm) | Spd (1/mm$^2$) |
|---|---|---|---|---|---|---|---|---|---|---|---|---|---|---|
| Example 26 | Z-26 | 1 | 21 | 22 | 22 | 1088 | 12.9 | 8% | 31 | 3.0 | 40% | 10 | 8.3 | 3.5.E+04 |
| Example 27 | Z-27 | 1 | 20 | 22 | 22 | 1042 | 19.9 | 20% | 31 | 7.9 | 25% | 10 | 14.9 | 1.0.E+04 |
| Example 28 | Z-28 | 1 | 22 | 21 | 21 | 1000 | 20.0 | 20% | 31 | 3.0 | 40% | 11 | 16.0 | 3.5.E+04 |
| Example 29 | Z-29 | 1 | 21 | 22 | 22 | 1990 | 12.9 | 8% | 31 | 7.9 | 25% | 10 | 8.1 | 1.0.E+04 |
| Example 30 | Z-30 | 1 | 22 | 22 | 21 | 1995 | 12.9 | 8% | 31 | 3.0 | 40% | 11 | 8.1 | 3.5.E+04 |
| Example 31 | Z-31 | 1 | 21 | 20 | 21 | 1999 | 19.9 | 20% | 30 | 8.0 | 25% | 10 | 15.5 | 1.0.E+04 |
| Example 32 | Z-32 | 1 | 20 | 21 | 21 | 2000 | 19.9 | 20% | 31 | 3.0 | 40% | 10 | 16.0 | 3.5.E+04 |

TABLE 9

| Comparative Example | Developing roller | Electro-conductive elastic layer Elastic modulus (MPa) $E_e$ | Binder resin Elastic modulus (MPa) $E_b0$ | $E_b1$ | $E_b$ | First resin particle Elastic modulus (MPa) $E_1$ | Dv1 (μm) | V1 | Second resin particle Elastic modulus (MPa) $E_2$ | Dv2 (μm) | V2 | Film thickness of surface layer (μm) | Average value of Rz (μm) | Spd (1/mm$^2$) |
|---|---|---|---|---|---|---|---|---|---|---|---|---|---|---|
| Comparative Example 1 | K-1 | 1 | 100 | 108 | 92 | 7419 | 14.9 | 15% | 33 | 5.9 | 35% | 10 | 10.1 | 2.2.E+04 |
| Comparative Example 2 | K-2 | 1 | 98 | 104 | 99 | 806 | 15.0 | 15% | 31 | 6.0 | 35% | 10 | 10.1 | 1.9.E+04 |

TABLE 9-continued

| Comparative Example | Developing roller | Electro-conductive elastic layer Elastic modulus (MPa) $E_e$ | Binder resin Elastic modulus (MPa) $E_b0$ | $E_b1$ | $E_b$ | First resin particle Elastic modulus (MPa) $E_1$ | Dv1 (μm) | V1 | Second resin particle Elastic modulus (MPa) $E_2$ | Dv2 (μm) | V2 | Film thickness of surface layer (μm) | Average value of Rz (μm) | Spd (1/mm$^2$) |
|---|---|---|---|---|---|---|---|---|---|---|---|---|---|---|
| Comparative Example 3 | K-3 | 1 | 95 | 110 | 93 | 32 | 15.0 | 15% | 2 | 5.1 | 35% | 11 | 10.5 | 2.0.E+04 |
| Comparative Example 4 | K-4 | 1 | 98 | 106 | 97 | 2000 | 12.9 | 3% | 5335 | 5.0 | 15% | 10 | 5.9 | 7.1.E+03 |
| Comparative Example 5 | K-5 | 1 | 99 | 103 | 93 | 100 | 8.0 | 1% | 33 | 6.0 | 15% | 10 | 3.9 | 8.7.E+03 |
| Comparative Example 6 | K-6 | 1 | 100 | 100 | 95 | 103 | 30.0 | 30% | 32 | 6.0 | 15% | 11 | 30.2 | 8.5.E+03 |
| Comparative Example 7 | K-7 | 1 | 100 | 109 | 93 | 104 | 13.0 | 3% | — | — | — | 10 | 7.0 | 5.2.E+02 |
| Comparative Example 8 | K-8 | 1 | 99 | 102 | 99 | 108 | 12.9 | 3% | 2 | 2.0 | 55% | 10 | 6.1 | 6.2.E+04 |
| Comparative Example 9 | K-9 | 1 | 1081 | 1032 | 1042 | 106 | 13.0 | 3% | 50 | 8.0 | 15% | 11 | 5.7 | 6.9.E+03 |

TABLE 10

| Example | Developing roller | Granularity in one-dot image | Decrease of density of one-dot image | White spot |
|---|---|---|---|---|
| Example 1 | Z-1 | B | A | A |
| Example 2 | Z-2 | C | C | C |
| Example 3 | Z-3 | B | C | C |
| Example 4 | Z-4 | C | A | B |
| Example 5 | Z-5 | C | A | B |
| Example 6 | Z-6 | B | A | B |
| Example 7 | Z-7 | C | C | C |
| Example 8 | Z-8 | C | B | B |
| Example 9 | Z-9 | C | C | C |
| Example 10 | Z-10 | B | B | B |
| Example 11 | Z-11 | C | C | C |
| Example 12 | Z-12 | C | B | B |
| Example 13 | Z-13 | C | C | C |
| Example 14 | Z-14 | B | B | B |
| Example 15 | Z-15 | C | C | C |
| Example 16 | Z-16 | B | B | C |
| Example 17 | Z-17 | C | C | C |
| Example 18 | Z-18 | C | B | B |
| Example 19 | Z-19 | B | A | B |
| Example 20 | Z-20 | C | A | B |
| Example 21 | Z-21 | B | B | B |
| Example 22 | Z-22 | B | B | B |
| Example 23 | Z-23 | B | A | B |
| Example 24 | Z-24 | B | A | B |
| Example 25 | Z-25 | B | A | A |
| Example 26 | Z-26 | B | A | A |
| Example 27 | Z-27 | B | A | A |
| Example 28 | Z-28 | B | A | A |
| Example 29 | Z-29 | B | A | A |
| Example 30 | Z-30 | B | A | A |
| Example 31 | Z-31 | B | A | A |
| Example 32 | Z-32 | B | A | A |

TABLE 11

| | Developing roller | Granularity in one-dot image | Decrease of density of one-dot image | White spot |
|---|---|---|---|---|
| Comparative Example 1 | K-1 | D | B | D |
| Comparative Example 2 | K-2 | D | C | D |
| Comparative Example 3 | K-3 | C | D | D |
| Comparative Example 4 | K-4 | D | C | D |
| Comparative Example 5 | K-5 | C | D | D |
| Comparative Example 6 | K-6 | D | A | C |
| Comparative Example 7 | K-7 | D | C | C |
| Comparative Example 8 | K-8 | D | C | C |
| Comparative Example 9 | K-9 | D | C | D |

6. Examples 33 to 62; Manufacture of Developing Rollers Z-33 to Z-62

<6-1. Preparation of Surface Layer Coating Liquids X-33 to X-54>

Surface layer coating liquids X-33 to X-54 of composition shown in the following Table 12 were prepared. In addition, the details of the additives F1 to F3 used in Table 12 are described in Table 14.

TABLE 12

| Surface layer coating liquid | Polyol Type | Parts by mass | Isocyanate type | Parts by mass | Electro-conductive agent Type | Parts by mass | First resin particle Type | Parts by mass | Second resin particle Type | Parts by mass | Additive Type | Parts by mass |
|---|---|---|---|---|---|---|---|---|---|---|---|---|
| X-33 | A-1 | 42 | B-1 | 58 | C-1 | 25 | D-1 | 33 | E-1 | 77 | F-1 | 3 |
| X-34 | A-1 | 42 | B-1 | 58 | C-1 | 25 | D-5 | 13 | E-2 | 41 | F-1 | 3 |
| X-35 | A-1 | 42 | B-1 | 58 | C-1 | 25 | D-5 | 19 | E-3 | 105 | F-1 | 3 |

TABLE 12-continued

| Surface layer | Polyol | | Isocyanate | | Electro-conductive agent | | First resin particle | | Second resin particle | | Additive | |
|---|---|---|---|---|---|---|---|---|---|---|---|---|
| coating liquid | Type | Parts by mass | type | Parts by mass | Type | Parts by mass | Type | Parts by mass | Type | Parts by mass | Type | Parts by mass |
| X-36 | A-1 | 42 | B-1 | 58 | C-1 | 25 | D-6 | 40 | E-2 | 50 | F-1 | 3 |
| X-37 | A-1 | 42 | B-1 | 58 | C-1 | 25 | D-6 | 63 | E-3 | 141 | F-1 | 3 |
| X-38 | A-1 | 42 | B-1 | 58 | C-1 | 25 | D-2 | 4 | E-2 | 20 | F-1 | 3 |
| X-39 | A-1 | 42 | B-1 | 58 | C-1 | 25 | D-2 | 7 | E-3 | 117 | F-1 | 3 |
| X-40 | A-1 | 42 | B-1 | 58 | C-1 | 25 | D-3 | 46 | E-2 | 28 | F-1 | 3 |
| X-41 | A-1 | 42 | B-1 | 58 | C-1 | 25 | D-3 | 110 | E-3 | 220 | F-1 | 3 |
| X-42 | A-4 | 6 | B-1 | 94 | C-1 | 25 | D-2 | 13 | E-6 | 41 | F-1 | 3 |
| X-43 | A-3 | 42 | B-2 | 58 | C-1 | 25 | D-2 | 13 | E-6 | 41 | F-1 | 3 |
| X-44 | A-1 | 42 | B-1 | 58 | C-1 | 25 | D-2 | 13 | E-6 | 41 | F-1 | 3 |
| X-45 | A-2 | 73 | B-1 | 27 | C-1 | 25 | D-2 | 13 | E-6 | 41 | F-1 | 3 |
| X-46 | A-3 | 42 | B-2 | 58 | C-1 | 25 | D-2 | 4 | E-2 | 20 | F-1 | 3 |
| X-47 | A-3 | 42 | B-2 | 58 | C-1 | 25 | D-2 | 13 | E-2 | 41 | F-1 | 3 |
| X-48 | A-3 | 42 | B-2 | 58 | C-1 | 25 | D-2 | 4 | E-2 | 20 | F-2 | 3 |
| X-49 | A-3 | 42 | B-2 | 58 | C-1 | 25 | D-2 | 13 | E-2 | 41 | F-2 | 3 |
| X-50 | A-3 | 42 | B-2 | 58 | C-1 | 25 | D-2 | 4 | E-2 | 20 | F-3 | 3 |
| X-51 | A-3 | 42 | B-2 | 58 | C-1 | 25 | D-2 | 13 | E-2 | 41 | F-3 | 3 |
| X-52 | A-3 | 42 | B-2 | 58 | C-1 | 25 | D-2 | 4 | E-2 | 20 | — | — |
| X-53 | A-3 | 42 | B-2 | 58 | C-1 | 25 | D-2 | 13 | E-2 | 41 | — | — |
| X-54 | A-3 | 42 | B-2 | 58 | C-1 | 25 | D-2 | 13 | E-2 | 41 | — | — |

<6-2. Preparation of Impregnation Coating Liquid W-1>

The raw materials of the composition shown in the following were mixed. Acrylic monomer G-1 (trade name: NK ester A-NPG, manufactured by Shin Nakamura chemical Co., Ltd.):100.0 parts by mass Photopolymerization initiator H-1 (trade name: Omnirad 184, manufactured by IGM Resins Co., Ltd.):10.0 parts by mass Next, methyl ethyl ketone (MEK) was added so that the solid content of the above raw material became 11% by mass, and an impregnation coating liquids W-1 was obtained by stirring for 3 hours.

<6-3. Preparation of Impregnation Coating Liquids W-2 to W-4>

Impregnation coating liquids W-2 to W-4 were prepared in the same manner as that for the impregnation coating liquid W-1, except that the formulation was changed to those described in Table 13. In addition, the details of the acrylic monomers G1 to G4 and photopolymerization initiator H-1, H-2 used in Table 13 are described in Table 14.

TABLE 13

| Impregnation coating liquid | Acrylic monomer | | Photopolymerization initiator | | Solid content |
|---|---|---|---|---|---|
| | Type | Parts by mass | Type | Parts by mass | |
| W - 1 | G - 1 | 100 | H - 1 | 10 | 11% |
| W - 2 | G - 2 | 100 | H - 2 | 1 | 1% |
| W - 3 | G - 3 | 100 | H - 1 | 20 | 24% |
| W - 4 | G - 4 | 100 | H - 1 | 20 | 12% |

TABLE 14

| | Name of compound |
|---|---|
| F-1 | Polyether-modified silicone oil (trade name: TSF4446, HLB value: 5, manufactured by Momentive Performance Materials, Co., Ltd.) |
| F-2 | Polyether-modified fluorine compound (trade name: Megafac F444, HLB value: 8, manufactured by DIC Corporation) |
| F-3 | Polyether-modified silicone oil (trade name: TSF4452, HLB value: 11, manufactured by Momentive Performance Materials, Co., Ltd.) |
| G-1 | Neopentyl glycol diacrylate (number of functional groups: 2, viscosity: 6 mPa-s/25° C., trade name: NK ester A-NPG, manufactured by Shin Nakamura Chemical Co., Ltd.) |
| G-2 | PO-modified neopentyl glycol diacrylate (number of functional groups: 2, viscosity: 20 mPa-s/25° C., trade name: EBECRYL145, manufactured by Daicel-Allnex Ltd.) |
| G-3 | Pentaerythritol alkoxytetraacrylate (number of functional groups: 4, viscosity: 160 mPa-s/25° C., trade name: EBECRYL40, manufactured by Daicel-Allnex Ltd.) |
| G-4 | Dipentaerythritol hexaacrylate modified by 12 moles of ethylene oxide (number of functional groups: 6, viscosity: 400 mPa-s/25° C., trade name: KAYARAD DPEA-12, manufactured by Nippon Kayaku Co., Ltd.) |
| H-1 | α-hydroxyalkylphenone (radical photopolymerization initiator, trade name: Omnirad 184, manufactured by IGM Resins) |
| H-2 | α-hydroxyacetophenone (radical photopolymerization initiator, trade name: Omnirad 127, manufactured by IGM Resins) |

<6-4. Manufacture of Rollers Y-1 to Y-30>

Rollers Y-1 to Y-30 having the surface layer coated on the electro-conductive elastic layer roller were manufactured in the same manner as that in Example 1, except that the surface layer coating liquid X-1 was changed to the surface layer coating liquids, respectively, shown in Table 14.

TABLE 15

| Roller | Electro-conductive elastic layer roller | Surface layer coating liquid |
|---|---|---|
| Y-1 | 1 | X-33 |
| Y-2 | 1 | X-34 |
| Y-3 | 1 | X-35 |
| Y-4 | 1 | X-36 |
| Y-5 | 1 | X-37 |
| Y-6 | 1 | X-34 |
| Y-7 | 1 | X-35 |
| Y-8 | 1 | X-36 |
| Y-9 | 1 | X-37 |
| Y-10 | 1 | X-34 |
| Y-11 | 1 | X-35 |
| Y-12 | 1 | X-36 |
| Y-13 | 1 | X-37 |
| Y-14 | 1 | X-38 |
| Y-15 | 1 | X-39 |
| Y-16 | 1 | X-40 |
| Y-17 | 1 | X-41 |
| Y-18 | 1 | X-42 |
| Y-19 | 1 | X-43 |
| Y-20 | 1 | X-44 |
| Y-21 | 1 | X-45 |
| Y-22 | 1 | X-46 |
| Y-23 | 1 | X-47 |
| Y-24 | 1 | X-48 |
| Y-25 | 1 | X-49 |
| Y-26 | 1 | X-50 |
| Y-27 | 1 | X-51 |
| Y-28 | 1 | X-52 |
| Y-29 | 1 | X-53 |
| Y-30 | 1 | X-54 |

<6-5. (Example 33; Manufacture of Developing Roller Z-33)>

The above roller Y-1 was once dipped in and was impregnated with an impregnation coating liquid W-1, and then was air-dried at 23° C. for 120 minutes. In addition, a raising speed in the dipping application was 20 mm/sec. Next, the surface of the roller Y-1 was irradiated with UV light in the air atmosphere with the use of a high-pressure mercury UV lamp (trade name: handy type UV curing apparatus, manufactured by Mario Network Inc.) so that the integrated quantity of light became 15000 mJ/cm$^2$, while the roller Y-1 was rotated in the circumferential direction of the roller provided with the surface layer, at 20 rpm; and the acrylic monomer was cross-linked and cured. In the above way, the developing roller Z-33 was manufactured which was subjected to the impregnation treatment.

Next, the physical properties and the images of the manufactured developing roller Z-33 of Example 33 were evaluated in the same manner as that in Example 1. The results are shown in Tables 17 and 18.

<6-6. (Examples 34 to 62; Manufacture of Developing Rollers Z-34 to Z-62)>

The developing rollers Z-34 to Z-62 were manufactured in the same manner as that in Example 33, except that the roller Y-1 and the surface layer coating liquid W-1 were changed to those as described in Table 16. The physical properties and the images of the manufactured developing rollers Z-34 to Z-62 of Examples 34 to 62 were evaluated in the same manner as that in Example 1. The results are shown in Tables 17 and 18.

TABLE 16

| | Developing roller | Roller Y No. | Impregnation coating liquid No. |
|---|---|---|---|
| Example 33 | Z-33 | Y-1 | W-1 |
| Example 34 | Z-34 | Y-2 | W-1 |
| Example 35 | Z-35 | Y-3 | W-1 |
| Example 36 | Z-36 | Y-4 | W-1 |
| Example 37 | Z-37 | Y-5 | W-1 |
| Example 38 | Z-38 | Y-6 | W-2 |
| Example 39 | Z-39 | Y-7 | W-2 |
| Example 40 | Z-40 | Y-8 | W-2 |
| Example 41 | Z-41 | Y-9 | W-2 |
| Example 42 | Z-42 | Y-10 | W-3 |
| Example 43 | Z-43 | Y-11 | W-3 |
| Example 44 | Z-44 | Y-12 | W-3 |
| Example 45 | Z-45 | Y-13 | W-3 |
| Example 46 | Z-46 | Y-14 | W-1 |
| Example 47 | Z-47 | Y-15 | W-1 |
| Example 48 | Z-48 | Y-16 | W-1 |
| Example 49 | Z-49 | Y-17 | W-1 |
| Example 50 | Z-50 | Y-18 | W-1 |
| Example 51 | Z-51 | Y-19 | W-1 |
| Example 52 | Z-52 | Y-20 | W-1 |
| Example 53 | Z-53 | Y-21 | W-1 |
| Example 54 | Z-54 | Y-22 | W-3 |
| Example 55 | Z-55 | Y-23 | W-3 |
| Example 56 | Z-56 | Y-24 | W-3 |
| Example 57 | Z-57 | Y-25 | W-3 |
| Example 58 | Z-58 | Y-26 | W-3 |
| Example 59 | Z-59 | Y-27 | W-3 |
| Example 60 | Z-60 | Y-28 | W-3 |
| Example 61 | Z-61 | Y-29 | W-3 |
| Example 62 | Z-62 | Y-30 | W-4 |

TABLE 17

| | | Electro-conductive elastic layer | Binder resin | | | First resin particle | | | Second resin particle | | | | | |
|---|---|---|---|---|---|---|---|---|---|---|---|---|---|---|
| | Developing | Elastic modulus (MPa) | Elastic modulus (MPa) | | | Elastic modulus (MPa) | Dv1 | | Elastic modulus (MPa) | Dv2 | | Film thickness of surface | Average value of | Spd |
| Example | roller | $E_e$ | $E_b0$ | $E_b1$ | $E_b$ | $E_1$ | (μm) | V1 | $E_2$ | (μm) | V2 | layer (μm) | Rz (μm) | (1/mm$^2$) |
| 33 | Z-33 | 1 | 1014 | 21 | 21 | 1023 | 14.9 | 15% | 31 | 6.0 | 35% | 11 | 10.1 | 2.3.E+04 |
| 34 | Z-34 | 1 | 1027 | 21 | 22 | 1050 | 12.9 | 8% | 33 | 8.0 | 25% | 10 | 8.3 | 1.0.E+04 |
| 35 | Z-35 | 1 | 1036 | 21 | 22 | 1071 | 13.0 | 8% | 33 | 3.0 | 45% | 10 | 8.1 | 3.5.E+04 |
| 36 | Z-36 | 1 | 1077 | 21 | 22 | 1015 | 20.0 | 20% | 32 | 7.9 | 25% | 10 | 15.5 | 1.0.E+04 |
| 37 | Z-37 | 1 | 1032 | 22 | 22 | 1025 | 20.0 | 20% | 31 | 3.0 | 45% | 10 | 15.9 | 3.5.E+04 |
| 38 | Z-38 | 1 | 202 | 50 | 48 | 1092 | 12.9 | 8% | 33 | 8.0 | 25% | 10 | 8.0 | 1.0.E+04 |
| 39 | Z-39 | 1 | 200 | 50 | 50 | 1031 | 12.9 | 8% | 31 | 3.0 | 45% | 10 | 8.0 | 3.4.E+04 |
| 40 | Z-40 | 1 | 202 | 49 | 48 | 1081 | 19.9 | 20% | 31 | 7.9 | 25% | 11 | 15.5 | 1.1.E+04 |

TABLE 17-continued

| Example | Developing roller | Electro-conductive elastic layer Elastic modulus (MPa) $E_e$ | Binder resin Elastic modulus (MPa) $E_b0$ | $E_b1$ | $E_b$ | First resin particle Elastic modulus (MPa) $E_1$ | Dv1 (μm) | V1 | Second resin particle Elastic modulus (MPa) $E_2$ | Dv2 (μm) | V2 | Film thickness of surface layer (μm) | Average value of Rz (μm) | Spd (1/mm$^2$) |
|---|---|---|---|---|---|---|---|---|---|---|---|---|---|---|
| 41 | Z-41 | 1 | 207 | 48 | 49 | 1051 | 19.8 | 20% | 31 | 3.0 | 45% | 10 | 16.0 | 3.5.E+04 |
| 42 | Z-42 | 1 | 29957 | 53 | 27 | 1075 | 13.0 | 8% | 31 | 7.9 | 25% | 11 | 8.0 | 1.0.E+04 |
| 43 | Z-43 | 1 | 30000 | 51 | 27 | 1039 | 12.9 | 8% | 31 | 3.0 | 40% | 11 | 8.0 | 3.5.E+04 |
| 44 | Z-44 | 1 | 29872 | 54 | 26 | 1098 | 19.9 | 20% | 30 | 7.9 | 25% | 10 | 14.9 | 1.0.E+04 |
| 45 | Z-45 | 1 | 28364 | 53 | 27 | 1038 | 19.9 | 20% | 30 | 3.0 | 40% | 11 | 15.8 | 3.5.E+04 |
| 46 | Z-46 | 1 | 1064 | 21 | 21 | 100 | 12.9 | 3% | 32 | 7.9 | 15% | 10 | 6.0 | 5.0.E+03 |
| 47 | Z-47 | 1 | 1007 | 20 | 20 | 109 | 13.0 | 3% | 32 | 3.0 | 50% | 11 | 6.1 | 4.9.E+04 |
| 48 | Z-48 | 1 | 1088 | 21 | 21 | 101 | 19.8 | 25% | 33 | 8.0 | 15% | 11 | 16.9 | 6.0.E+03 |
| 49 | Z-49 | 1 | 1071 | 21 | 20 | 106 | 19.8 | 25% | 32 | 3.0 | 50% | 10 | 18.0 | 5.0.E+04 |
| 50 | Z-50 | 1 | 1059 | 100 | 98 | 107 | 12.9 | 8% | 50 | 8.0 | 25% | 10 | 8.0 | 1.0.E+04 |
| 51 | Z-51 | 1 | 1014 | 51 | 50 | 103 | 13.0 | 8% | 49 | 7.9 | 25% | 10 | 8.1 | 1.0.E+04 |
| 52 | Z-52 | 1 | 1090 | 21 | 20 | 109 | 13.0 | 8% | 50 | 8.0 | 25% | 10 | 8.0 | 1.1.E+04 |
| 53 | Z-53 | 1 | 1072 | 10 | 10 | 106 | 13.0 | 8% | 50 | 8.0 | 25% | 11 | 8.0 | 1.0.E+04 |
| 54 | Z-54 | 1 | 30000 | 60 | 50 | 100 | 12.9 | 3% | 30 | 7.9 | 15% | 10 | 6.1 | 6.3.E+04 |
| 55 | Z-55 | 1 | 27999 | 63 | 50 | 108 | 13.0 | 8% | 31 | 8.0 | 25% | 10 | 8.1 | 1.1.E+04 |
| 56 | Z-56 | 1 | 20201 | 80 | 50 | 104 | 13.0 | 3% | 29 | 8.0 | 15% | 10 | 6.0 | 5.8.E+03 |
| 57 | Z-57 | 1 | 21877 | 79 | 50 | 109 | 13.0 | 8% | 30 | 8.0 | 25% | 11 | 8.5 | 1.0.E+03 |
| 58 | Z-58 | 1 | 5376 | 100 | 64 | 103 | 12.9 | 3% | 38 | 8.0 | 15% | 11 | 6.0 | 5.5.E+03 |
| 59 | Z-59 | 1 | 5028 | 100 | 64 | 104 | 13.0 | 8% | 48 | 7.9 | 25% | 10 | 8.0 | 1.2.E+04 |
| 60 | Z-60 | 1 | 512 | 321 | 83 | 107 | 13.0 | 3% | 50 | 7.9 | 15% | 10 | 6.3 | 5.2.E+03 |
| 61 | Z-61 | 1 | 506 | 328 | 84 | 102 | 13.0 | 8% | 50 | 7.9 | 25% | 10 | 8.1 | 1.0.E+04 |
| 62 | Z-62 | 1 | 1015 | 310 | 95 | 109 | 12.9 | 8% | 50 | 8.0 | 25% | 11 | 8.1 | 1.0.E+04 |

TABLE 18

| Example | Developing roller | Granularity in one-dot image | Decrease of density of one-dot image | White spot |
|---|---|---|---|---|
| Example 32 | Z-32 | B | A | A |
| Example 33 | Z-33 | A | A | A |
| Example 34 | Z-34 | A | A | A |
| Example 35 | Z-35 | A | A | A |
| Example 36 | Z-36 | A | A | A |
| Example 37 | Z-37 | A | A | A |
| Example 38 | Z-38 | A | A | A |
| Example 39 | Z-39 | A | A | A |
| Example 40 | Z-40 | A | A | A |
| Example 41 | Z-41 | A | A | A |
| Example 42 | Z-42 | A | A | A |
| Example 43 | Z-43 | A | A | A |
| Example 44 | Z-44 | A | A | A |
| Example 45 | Z-45 | A | A | A |
| Example 46 | Z-46 | A | A | B |
| Example 47 | Z-47 | A | A | B |
| Example 48 | Z-48 | A | A | A |
| Example 49 | Z-49 | A | A | A |
| Example 50 | Z-50 | B | A | A |
| Example 51 | Z-51 | A | A | A |
| Example 52 | Z-52 | A | A | A |
| Example 53 | Z-53 | A | A | A |
| Example 54 | Z-54 | A | A | A |
| Example 55 | Z-55 | A | A | A |
| Example 56 | Z-56 | A | A | A |
| Example 57 | Z-57 | A | A | A |
| Example 58 | Z-58 | A | A | B |
| Example 59 | Z-59 | A | A | A |
| Example 60 | Z-60 | B | A | B |
| Example 61 | Z-61 | B | A | B |
| Example 62 | Z-62 | B | B | B |

As shown in Tables 10, 11 and 18, high-quality images were obtained from the developing rollers of Examples 1 to 62 which satisfied the structure of the present disclosure, through the endurance. Particularly in Examples 33 to 62, a higher quality image was obtained due to the matrix of the surface layer being highly hardened in the vicinity of the outer surface of the surface layer.

On the other hand, in the developing roller of Comparative Example 1, the white spot was poor. This is assumed to be because the first resin particle therein was an acrylic resin particle and the elastic modulus was higher than 2000 MPa. In addition, the granularity in the one-dot image quality was also poor. This is assumed to be because the adhesiveness of the first resin particle to the matrix of the surface layer was lower than that of the polyurethane resin particle.

In the developing roller of Comparative Example 2, the elastic modulus of the acrylic resin particle was controlled to a range of the elastic modulus of the first resin particle of the present disclosure, but the white spot and the granularity in the one-dot image were not improved.

In the developing roller of Comparative Example 3, the density of the one-dot image greatly decreased and the white spot was also poor. This is assumed to be because though the urethane particle was used there as the first resin particle, the urethane particle could not scrape off the contaminant on the outer surface of the photosensitive member, because the elastic modulus of the particle was below the range of the present disclosure.

In the developing roller of Comparative Example 4, the granularity in the one-dot image was poor. This is assumed to be because the particle was used there as the second resin particle, of which the elastic modulus exceeded a range of the present disclosure, and as a result, the region in which the second resin particles existed was highly hardened, and could not form an arch-like rising part. In addition, it is assumed that the whole surface layer was highly hardened, thereby the deterioration of the toner was accelerated, and the white spot deteriorated.

In the developing roller of Comparative Example 5, the density of the one-dot image greatly decreased, and the white spot was also poor. This is assumed to be because particles of which the volume average particle diameter was small were used there in a small amount as the first resin particle, accordingly the average value of the maximum heights Rz was below a range of the present disclosure, and as a result, the first resin particle could not scrape off the contaminant on the outer surface of the photosensitive member.

In the developing roller of Comparative Example 6, the granularity in the one-dot image deteriorated. This is assumed to be because resin particles of which the volume average particle diameter was large were used in a large amount there, as the first resin particle, and the average value of the maximum heights Rz exceeded a range of the present disclosure. In the developing roller of Comparative Example 7, the granularity in the one-dot image deteriorated. This is assumed to be because the second resin particle was not used there, thereby the second protrusions did not exist, and the peak vertex density Spd was below a range of the present disclosure, and thereby the effect of leveling the disarranged toner on the outer surface of the photosensitive member could not be obtained.

In the developing roller of Comparative Example 8, the granularity in the one-dot image deteriorated. This is assumed to be because particles of which the volume average particle diameter was small were used there in a large amount as the second resin particle, as a result, the peak vertex density Spd exceeded a range of the present disclosure, and accordingly the effect of leveling the disarranged toner decreased.

In the developing roller of Comparative Example 9, the granularity in the one-dot image was poor. This is assumed to be because the elastic modulus $E_b$ of the matrix thereof in the depth of 1 μm or deeper exceeded a range of the present disclosure, and as a result, the region in which the second resin particles existed was highly hardened, and could not form the arch-like rising part. In addition, it is assumed that the entire surface layer was highly hardened, thereby the deterioration of the toner was accelerated, and the white spot deteriorated.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-070139, filed Apr. 1, 2019, which is hereby incorporated by reference herein in its entirety.

What is claimed is:

1. A developing roller comprising:

an electro-conductive substrate;

an electro-conductive elastic layer on the electro-conductive substrate; and a surface layer on the electro-conductive elastic layer, the surface layer comprising a matrix and resin particles dispersed in the matrix, the matrix containing polyurethane as a binder, the resin particles including a first resin particle and a second resin particle, an elastic modulus $E_b$ of the matrix at a region which is a depth of 1.0 μm or more from an outer surface of the surface layer is 10 to 100 MPa when measured in a cross section in a thickness direction of the surface layer, the outer surface of the surface layer having a first protrusion and a second protrusion, the second protrusion existing in an area which is free from the first protrusion, the second protrusion having a height lower than a height of the first protrusion by 5.0 μm or more, the first protrusion being formed by the first resin particle, the second protrusion being formed by the second resin particle, the first resin particle comprising polyurethane, and having an elastic modulus $E_1$ of 100 to 2000 MPa when measured in a cross section in a thickness direction of the surface layer, the second resin particle having an elastic modulus $E_2$ of 2 to 50 MPa when measured in a cross section in the thickness direction of the surface layer, the outer surface of the developing roller having a maximum height roughness of 6 to 18 μm, and having a peak vertex density Spd of $5.0\times10^3$ (1/mm$^2$) to $5.0\times10^4$ (1/mm$^2$).

2. The developing roller according to claim 1, wherein the first resin particle has a volume average particle diameter of 10 to 20 μm, and a volume ratio of the first resin particle in the surface layer is 3 to 25% by volume, and the second resin particle has a volume average particle diameter of 3 to 10 μm, and a volume ratio of the second resin particle in the surface layer is 15 to 50% by volume.

3. The developing roller according to claim 1, wherein the maximum height roughness Rz is 8 to 16 μm, and the peak vertex density Spd is $1.0\times10^4$ to $3.5\times10^4$ (1/mm$^2$).

4. The developing roller according to claim 1, wherein, in the surface layer, a volume ratio of the first resin particle is 8 to 20% by volume, and a volume ratio of the second resin particle is 25 to 40% by volume.

5. The developing roller according to claim 1, wherein the elastic modulus $E_1$ is 1000 to 2000 MPa.

6. The developing roller according to claim 1, wherein the matrix has an elastic modulus $E_b0$ of 200 MPa or more when measured at a first region in the cross section in the thickness direction of the surface layer, the first region ranging from the outer surface of the surface layer to a depth of 0.1 μm from the outer surface of the surface layer.

7. The developing roller according to claim 6, wherein the matrix has an elastic modulus $E_b1$ of 10 to 100 MPa, when measured at a second region in the cross section in the thickness direction of the surface layer, the second region ranging from a depth of 1.0 μm from the outer surface of the surface layer to a depth of 1.1 μm from the outer surface.

8. The developing roller according to claim 6, wherein the surface layer further comprises a cross-linked acrylic resin in a region ranging from the outer surface to a predetermined depth from the outer surface.

9. The developing roller according to claim 6, wherein the matrix in a region ranging from the outer surface of the surface layer to a predetermined depth from the outer surface of the surface layer, further comprises at least one of a silicone-based surface active agent and a fluorine-based surface active agent.

10. A process cartridge detachably mounted on a main body of an electrophotographic apparatus, comprising a developing roller, the developing roller comprising:

an electro-conductive substrate;

an electro-conductive elastic layer on the electro-conductive substrate; and a surface layer on the electro-conductive elastic layer, the surface layer comprising a matrix and resin particles dispersed in the matrix, the matrix containing polyurethane as a binder, the resin particles including a first resin particle and a second resin particle, the matrix has an elastic modulus $E_b$ of 10 to 100 MPa, the elastic modulus being measured at a region in a cross section in a thickness direction of the surface layer, the region being a depth of 1.0 μm or more from an outer surface of the surface layer, the outer surface of the surface layer is constituted by a first protrusion, and a second protrusion existing in an area which is free from the first protrusion, the second protrusion has a height lower than a height of the first protrusion by 5.0 μm or more, the first protrusion being formed by the first resin particle, and the second protrusion being formed by the second resin particle, the first resin particle comprising polyurethane, and having an elastic modulus $E_1$ of 100 to 2000 MPa, when measured in a cross section in a thickness direction of the surface layer, the second resin particle having an elastic modulus $E_2$ of 2 to 50 MPa, when measured in a cross section in the thickness direction of the surface layer, the outer surface of the developing roller having a maximum height roughness of 6 to 18 μm, and having a peak vertex density Spd of $5.0\times10^3$ (1/mm$^2$) to $5.0\times10^4$ (1/mm$^2$).

11. An electrophotographic image forming apparatus comprising: a photosensitive member; and a developing roller for supplying a developer to an electrostatic latent image formed on the photosensitive member, the developing roller comprising:

an electro-conductive substrate;

an electro-conductive elastic layer on the electro-conductive substrate; and a surface layer on the electro-conductive elastic layer, the surface layer comprising a matrix and resin particles dispersed in the matrix, the matrix containing polyurethane as a binder, the resin particles including a first resin particle and a second resin particle, the matrix has an elastic modulus $E_b$ of 10 to 100 MPa, the elastic modulus being measured at a region in a cross section in a thickness direction of the surface layer, the region being a depth of 1.0 μm or more from an outer surface of the surface layer, the outer surface of the surface layer is constituted by a first protrusion, and a second protrusion existing in an area which is free from the first protrusion, the second protrusion has a height lower than a height of the first protrusion by 5.0 μm or more, the first protrusion being formed by the first resin particle, and the second protrusion being formed by the second resin particle, the first resin particle comprising polyurethane, and having an elastic modulus $E_1$ of 100 to 2000 MPa, when measured in a cross section in a thickness direction of the surface layer, the second resin particle having an elastic modulus $E_2$ of 2 to 50 MPa, when measured in a cross section in the thickness direction of the surface layer, the outer surface of the developing roller having a maximum height roughness of 6 to 18 μm, and having a peak vertex density Spd of $5.0\times10^3$ (1/mm$^2$) to $5.0\times10^4$ (1/mm$^2$).

* * * * *